US010229698B1

(12) United States Patent
Chhetri

(10) Patent No.: US 10,229,698 B1
(45) Date of Patent: Mar. 12, 2019

(54) PLAYBACK REFERENCE SIGNAL-ASSISTED MULTI-MICROPHONE INTERFERENCE CANCELER

(71) Applicant: Amazon Technologies, Inc., Seattle, WA (US)

(72) Inventor: Amit Singh Chhetri, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 72 days.

(21) Appl. No.: 15/629,155

(22) Filed: Jun. 21, 2017

(51) Int. Cl.
*G10L 21/0208* (2013.01)
*G10L 21/0216* (2013.01)

(52) U.S. Cl.
CPC ..... *G10L 21/0208* (2013.01); *G10L 2021/02082* (2013.01); *G10L 2021/02166* (2013.01)

(58) Field of Classification Search
None
See application file for complete search history.

(56) References Cited

U.S. PATENT DOCUMENTS 5,625,684 A * 4/1997 Matouk ..... A61B 5/7475 379/392.01
6,339,758 B1 * 1/2002 Kanazawa ..... G10L 21/02 381/94.3
2006/0147063 A1 * 7/2006 Chen ..... H04M 1/03 381/119
2009/0271190 A1 * 10/2009 Niemisto ..... G10L 25/78 704/233
2010/0280824 A1 * 11/2010 Petit ..... G10L 21/0208 704/214
2011/0103603 A1 * 5/2011 Pan ..... G10L 21/0272 381/71.1
2011/0232989 A1 * 9/2011 Lee ..... G01S 3/8034 181/125
2012/0183154 A1 * 7/2012 Boemer ..... G10L 21/0208 381/94.1
2013/0073283 A1 * 3/2013 Yamabe ..... G10L 21/0216 704/226
2016/0112817 A1 * 4/2016 Fan ..... H04R 29/004 381/94.7
2016/0295322 A1 * 10/2016 Orescanin ..... H04R 3/005

* cited by examiner

*Primary Examiner* — Neeraj Sharma
(74) *Attorney, Agent, or Firm* — Pierce Atwood LLP

(57) ABSTRACT

An acoustic interference cancellation system that combines acoustic echo cancellation and an adaptive beamformer to cancel acoustic interference from an audio output. The system uses a fixed beamformer to generate a target signal in a look direction and an adaptive beamformer to generate noise reference signals corresponding to non-look directions. The noise reference signals are used to estimate acoustic noise using an acoustic interference canceller (AIC), while reference signals associated with loudspeakers are used to estimate an acoustic echo using a multi-channel acoustic echo canceller (MC-AEC). The system cancels the acoustic echo and the acoustic noise simultaneously by adding the estimate of the acoustic noise and the estimate of the acoustic echo to generate an interference reference signal and cancelling the interference reference signal from the target signal. The system jointly updates adaptive filters for the AIC and the MC-AEC logic to improve a robustness of the system.

20 Claims, 15 Drawing Sheets

PLAYBACK REFERENCE SIGNAL-ASSISTED MULTI-MICROPHONE INTERFERENCE CANCELER

BACKGROUND

In audio systems, acoustic echo cancellation (AEC) refers to techniques that are used to recognize when a system has recaptured sound via a microphone after some delay that the system previously output via a loudspeaker. Systems that provide AEC subtract a delayed version of the original audio signal from the captured audio, producing a version of the captured audio that ideally eliminates the "echo" of the original audio signal, leaving only new audio information. For example, if someone were singing karaoke into a microphone while prerecorded music is output by a loudspeaker, AEC can be used to remove any of the recorded music from the audio captured by the microphone, allowing the singer's voice to be amplified and output without also reproducing a delayed "echo" the original music. As another example, a media player that accepts voice commands via a microphone can use AEC to remove reproduced sounds corresponding to output media that are captured by the microphone, making it easier to process input voice commands.

BRIEF DESCRIPTION OF DRAWINGS

For a more complete understanding of the present disclosure, reference is now made to the following description taken in conjunction with the accompanying drawings.

DETAILED DESCRIPTION

Figure 1A:
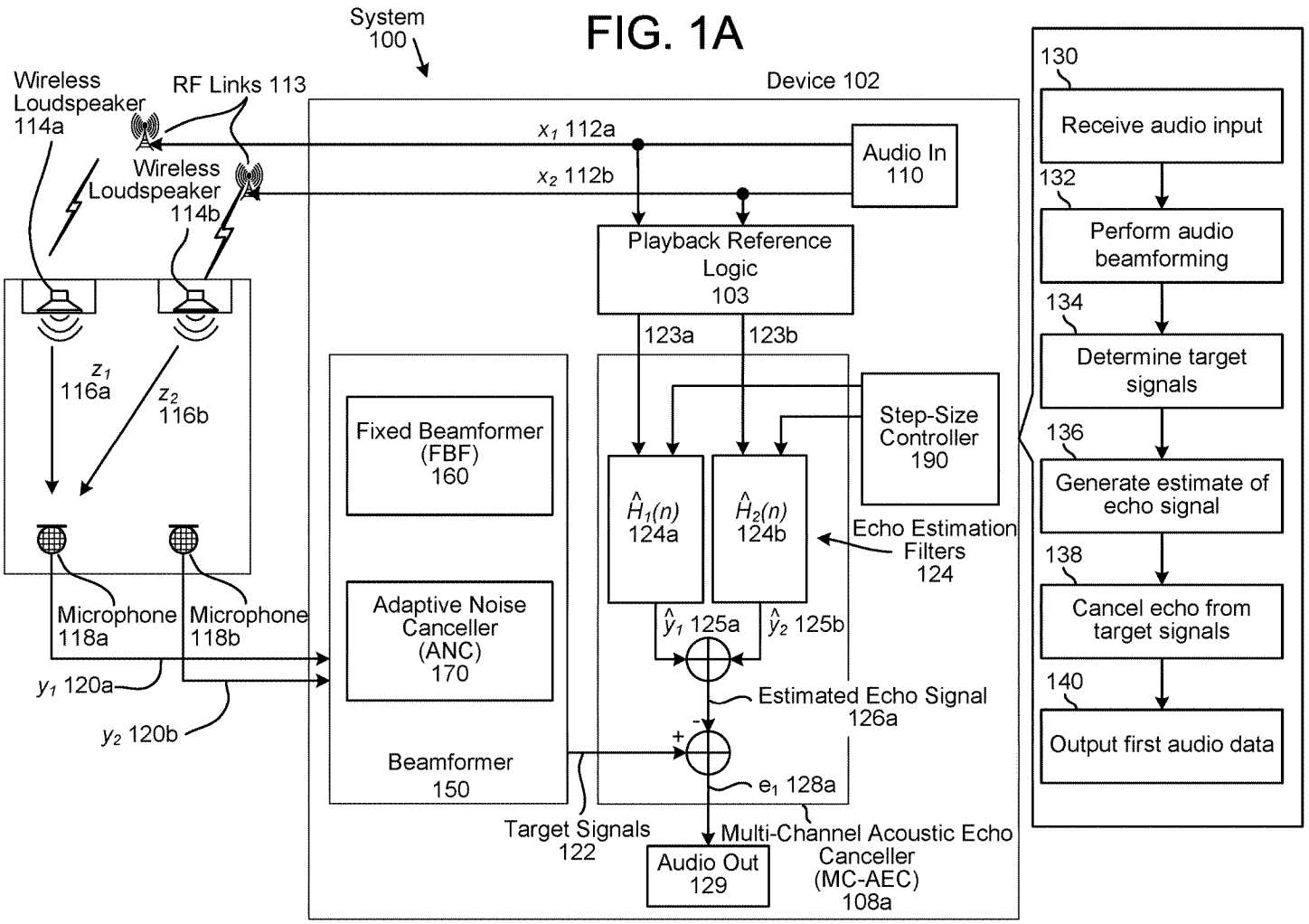
FIGS. 1A-1C illustrate acoustic interference cancellation systems according to embodiments of the present disclosure.

Typically, a conventional Acoustic Echo Cancellation (AEC) system may remove audio output by a loudspeaker from audio captured by the system's microphone(s) by subtracting a delayed version of the originally transmitted audio. However, in stereo and multi-channel audio systems that include wireless or network-connected loudspeakers and/or microphones, problem with the typical AEC approach may occur when there are differences between the signal sent to a loudspeaker and a signal received at the microphone. As the signal sent to the loudspeaker is not the same as the signal received at the microphone, the signal sent to the loudspeaker is not a true reference signal for the AEC system. For example, when the AEC system attempts to remove the audio output by the loudspeaker from audio captured by the system's microphone(s) by subtracting a delayed version of the originally transmitted audio, the audio captured by the microphone may be subtly different than the audio that had been sent to the loudspeaker.

There may be a difference between the signal sent to the loudspeaker and the signal played at the loudspeaker for one or more reasons. A first cause is a difference in clock synchronization (e.g., clock offset) between loudspeakers and microphones. For example, in a wireless "surround sound" 5.1 system comprising six wireless loudspeakers that each receive an audio signal from a surround-sound receiver, the receiver and each loudspeaker has its own crystal oscillator which provides the respective component with an independent "clock" signal. Among other things that the clock signals are used for is converting analog audio signals into digital audio signals ("A/D conversion") and converting digital audio signals into analog audio signals ("D/A conversion"). Such conversions are commonplace in audio systems, such as when a surround-sound receiver performs A/D conversion prior to transmitting audio to a wireless loudspeaker, and when the loudspeaker performs D/A conversion on the received signal to recreate an analog signal. The loudspeaker produces audible sound by driving a "voice coil" with an amplified version of the analog signal.

A second cause is that the signal sent to the loudspeaker may be modified based on compression/decompression during wireless communication, resulting in a different signal being received by the loudspeaker than was sent to the loudspeaker. A third case is non-linear post-processing performed on the received signal by the loudspeaker prior to playing the received signal. A fourth cause is buffering performed by the loudspeaker, which could create unknown latency, additional samples, fewer samples or the like that subtly change the signal played by the loudspeaker.

To perform Acoustic Echo Cancellation (AEC) without knowing the signal played by the loudspeaker, an Adaptive Reference Signal Selection Algorithm (ARSSA) AEC system may perform audio beamforming on a signal received by the microphones and may determine a reference signal (e.g., reference data) and a target signal (e.g., target data) based on the audio beamforming. For example, the ARSSA AEC system may receive audio input and separate the audio input into multiple directions. The ARSSA AEC system may detect a strong signal associated with a loudspeaker and may set the strong signal as a reference signal, selecting another direction as a target signal. In some examples, the ARSSA AEC system may determine a speech position (e.g., near end talk position) and may set the direction associated with the speech position as a target signal and an opposite direction as a reference signal. If the ARSSA AEC system cannot detect a strong signal or determine a speech position, the system may create pairwise combinations of opposite directions, with an individual direction being used as a target signal and a reference signal. The ARSSA AEC system may remove (e.g., cancel) the reference signal (e.g., audio output by the loudspeaker) to isolate speech included in the target signal.

In a linear system, there is no distortion, variable delay and/or frequency offset between the originally transmitted audio and the microphone input, and the conventional AEC system provides very good performance. However, when the system is nonlinear (e.g., there is distortion, variable delay and/or frequency offset), the ARSSA AEC system outperforms the conventional AEC system. In addition, a frequency offset and other nonlinear distortion between the originally transmitted audio and the microphone input affects higher frequencies differently than lower frequencies. For example, higher frequencies are rotated more significantly by the frequency offset relative to lower frequencies, complicating the task of removing the echo. Therefore, the conventional AEC system may provide good performance for low frequencies while the ARSSA AEC system may outperform the conventional AEC system for high frequencies.

To further improve echo cancellation, devices, systems and methods may combine the advantages of the conventional AEC system that uses a delayed version of the originally transmitted audio as a reference signal (e.g., playback reference signal, playback audio data, etc.) with the advantages of the Adaptive Reference Signal Selection Algorithm (ARSSA) AEC system that uses microphone input corresponding to the originally transmitted audio as a reference signal (e.g., adaptive reference signal) to generate an acoustic interference canceller (AIC). For example, a device may include a first conventional AEC circuit using the playback reference signal and a second ARSSA AEC circuit using the adaptive reference signal and may generate a combined output using both the first conventional AEC circuit and the second ARSSA AEC circuit (e.g., beamformer including a fixed beamformer and an adaptive beamformer). The AIC may cancel both an acoustic echo and acoustic noise (e.g., ambient acoustic noise), which may collectively be referred to as "acoustic interference" or just "interference."

FIG. 1A illustrates a high-level conceptual block diagram of echo-cancellation aspects of an AEC system 100 using reference signals. As illustrated, an audio input 110 provides multi-channel (e.g., stereo) audio "reference" signals $x_1(n)$ 112*a* and $x_2(n)$ 112*b* (e.g., playback reference signals). While FIG. 1A illustrates the audio input 110 providing only two reference signals 112, the disclosure is not limited thereto and the number of reference signals 112 may vary without departing from the disclosure. The reference signal $x_1(n)$ 112*a* is transmitted via a radio frequency (RF) link 113 to a wireless loudspeaker 114*a*, and the reference signal $x_2(n)$ 112*b* is transmitted via an RF link 113 to a wireless loudspeaker 114*b*. The disclosure is not limited thereto, and the reference signals 112 may be transmitted to the loudspeakers 114 using a wired connection without departing from the disclosure. The first wireless loudspeaker 114*a* outputs first audio $z_1(n)$ 116*a* and the second wireless loudspeaker 114*b* outputs second audio $z_2(n)$ 116*b* in a room 10 (e.g., an environment), and portions of the output sounds are captured by a pair of microphones 118*a* and 118*b* as "echo" signals $y_1(n)$ 120*a* and $y_2(n)$ 120*b* (e.g., input audio data), which contain some of the reproduced sounds from the reference signals $x_1(n)$ 112*a* and $x_2(n)$ 112*b*, in addition to any additional sounds (e.g., speech) picked up by the microphones 118. The echo signals y(n) 120 may be referred to as input audio data and may include a representation of the audible sound output by the loudspeakers 114 and/or a representation of speech input. In some examples, the echo signals y(n) 120 may be combined to generate combined echo signals y(n) 120 (e.g., combined input audio data), although the disclosure is not limited thereto. While FIG. 1A illustrates two microphones 118*a*/118*b*, the disclosure is not limited thereto and the system 100 may include any number of microphones 118 without departing from the present disclosure.

An audio signal is a representation of sound and an electronic representation of an audio signal may be referred to as audio data, which may be analog and/or digital without departing from the disclosure. For ease of illustration, the disclosure may refer to either audio signals (e.g., reference signals x(n), echo signal y(n), estimated echo signals $\hat{y}(n)$ or echo estimate signals $\hat{y}(n)$, error signal, etc.) or audio data (e.g., reference audio data or playback audio data, echo audio data or input audio data, estimated echo data or echo estimate data, error audio data, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure.

The portion of the sounds output by each of the loudspeakers 114*a*/114*b* that reaches each of the microphones 118*a*/118*b* (e.g., echo portion) can be characterized based on transfer functions. For example, the portion of the first audio $z_1(n)$ 116*a* between the first wireless loudspeaker 114*a* and the first microphone 118*a* can be characterized (e.g., modeled) using a first transfer function $h_{a1}(n)$ and the portion of the second audio $z_2(n)$ 116*b* between the second wireless loudspeaker 114*b* and the first microphone 118*a* can be characterized using a second transfer function $h_{a2}(n)$. Similarly, the portion of the first audio $z_1(n)$ 116*a* between the first wireless loudspeaker 114*a* and the second microphone 118*b* can be characterized (e.g., modeled) using a third transfer function $h_{b1}(n)$ and the portion of the second audio $z_2(n)$ 116*b* between the second wireless loudspeaker 114*b* and the second microphone 118*b* can be characterized using a fourth transfer function $h_{b2}(n)$. Thus, the number of transfer functions may vary depending on the number of loudspeakers 114 and/or microphones 118 without departing from the disclosure. The transfer functions h(n) vary with the relative positions of the components and the acoustics of the room 10. If the position of all of the objects in the room 10 are static, the transfer functions h(n) are likewise static. Conversely, if the position of an object in the room 10 changes, the transfer functions h(n) may change.

The transfer functions h(n) characterize the acoustic "impulse response" of the room 10 relative to the individual components. The impulse response, or impulse response function, of the room 10 characterizes the signal from a microphone when presented with a brief input signal (e.g., an audible noise), called an impulse. The impulse response describes the reaction of the system as a function of time. If the impulse response between each of the loudspeakers is known, and the content of the reference signals $x_1(n)$ 112*a* and $x_2(n)$ 112*b* output by the loudspeakers is known, then the transfer functions h(n) can be used to estimate the actual loudspeaker-reproduced sounds that will be received by a microphone (in this case, microphone 118*a*).

The "echo" signal $y_1(n)$ 120*a* contains some of the reproduced sounds from the reference signals $x_1(n)$ 112*a* and $x_2(n)$ 112*b*, in addition to any additional sounds picked up in the room 10. The echo signal $y_1(n)$ 120*a* can be expressed as:

$$y_1(n)=h_1(n)*x_1(n)+h_2(n)*x_2(n)+h_P(n)*x_P(n) \quad [1]$$

where $h_1(n)$, $h_2(n)$ and $h_P(n)$ are the loudspeaker-to-microphone impulse responses in the receiving room 10, $x_1(n)$ 112*a*, $x_2(n)$ 112*b* and $x_P(n)$ 112*c* are the loudspeaker reference signals for P loudspeakers, * denotes a mathematical convolution, and "n" is an audio sample.

Before estimating the echo signal $y_1(n)$ 120*a*, the device 102 may modify the reference signals 112 to compensate for distortion, variable delay, drift, skew and/or frequency offset. In some examples, the device 102 may include playback reference logic 103 that may receive the reference signals 112 (e.g., originally transmitted audio) and may compensate for distortion, variable delay, drift, skew and/or frequency offset to generate reference signals 123. For example, the playback reference logic 103 may determine a propagation delay between the reference signals 112 and the echo signals 120 and may modify the reference signals 112 to remove the propagation delay. Additionally or alternatively, the playback reference logic 103 may determine a frequency offset between the modified reference signals 112 and the echo signals 120 and may add/drop samples of the modified reference signals and/or the echo signals 120 to compensate for the frequency offset. For example, the playback reference logic 103 may add at least one sample per cycle when the frequency offset is positive and may remove at least one sample per cycle when the frequency offset is negative. Therefore, the reference signals 123 may be aligned with the echo signals 120.

A multi-channel acoustic echo canceller (MC-AEC) 108*a* calculates estimated transfer functions h(n), each of which models an acoustic echo (e.g., impulse response) between an individual loudspeaker 114 and an individual microphone 118. For example, a first echo estimation filter block 124 may use a first estimated transfer function $\hat{h}_1(n)$ that models a first transfer function $h_{a1}(n)$ between the first loudspeaker 114*a* and the first microphone 118*a* and a second echo estimation filter block 124 may use a second estimated transfer function $\hat{h}_2$ (n) that models a second transfer function $h_{a2}(n)$ between the second loudspeaker 114*b* and the first microphone 118*a*, and so on. For ease of illustration, FIG. 1A only illustrates a single set of transfer functions $\hat{h}(n)$, which would be associated with the first echo signal $y_1(n)$ 120*a*, but the device 102 may determine a set of transfer functions h(n) for each echo signal y(n) 120 without departing from the disclosure.

The echo estimation filter blocks 124 use the estimated transfer functions $\hat{h}_1(n)$ and $\hat{h}_2(n)$ to produce estimated echo signals $\hat{y}_1(n)$ 125*a* and $\hat{y}_2(n)$ 125*b*, respectively. For example, the MC-AEC 108*a* may convolve the reference signals 123 with the estimated transfer functions h(n) (e.g., estimated impulse responses of the room 10) to generate the estimated echo signals $\hat{y}(n)$ 125 (e.g., echo data). Thus, the MC-AEC 108*a* may convolve the first reference signal 123*a* by the first estimated transfer function $\hat{h}_1$ (n) to generate the first estimated echo signal 125*a*, which models a first portion of the echo signal $y_1(n)$ 120*a*, and may convolve the second reference signal 123*b* by the second estimated transfer function $\hat{h}_2$ (n) to generate the second estimated echo signal 125*b*, which models a second portion of the echo signal $y_1(n)$ 120*a*. The MC-AEC 108*a* may determine the estimated echo signals 125 using adaptive filters, as discussed in greater detail below. For example, the adaptive filters may be normalized least means squared (NLMS) finite impulse response (FIR) adaptive filters that adaptively filter the reference signals 123 using filter coefficients.

The estimated echo signals 125 (e.g., 125*a* and 125*b*) may be combined to generate an estimated echo signal $\hat{y}_1(n)$ 126*a* corresponding to an estimate of the echo component in the echo signal $y_1(n)$ 120*a*. The estimated echo signal can be expressed as:

$$y_1(n)=\hat{h}_1(k)*x_1(n)+\hat{h}_2(n)*x_2(n)+\hat{h}_P(n)x_P(n) \quad [2]$$

where * again denotes convolution. In a conventional AEC, subtracting the estimated echo signal 126*a* from the echo signal 120*a* produces a first error signal $e_1(n)$ 128*a*. Specifically:

$$\hat{e}_t(n)=y_1(n)-\hat{y}_1(n) \quad [3]$$

Thus, in a conventional AEC, this operation is performed for each echo signal y(n) 120 to generate multiple error signals e(n) 128. However, instead of removing the estimated echo signal 126*a* from the echo signal y(n) 120*a*, the system 100 may instead perform beamforming to determine one or more target signals 122 and may remove (e.g., cancel or subtract) the estimated echo signal 126*a* from a target signal 122. Thus, the target signals 122 generated by an adaptive beamformer 150 may be substituted for the echo signal $y_1(n)$ 120*a* without departing from the disclosure. Additionally or alternatively, the system 100 may generate estimated echo signals 126 for each of the microphones 118 and may sum the estimated echo signals 126 to generate a combined estimated echo signal and may cancel the combined estimated echo signal from the target signals 122 without departing from the disclosure.

For ease of explanation, the disclosure may refer to removing an estimated echo signal from a target signal to perform acoustic echo cancellation and/or removing an estimated interference signal from a target signal to perform acoustic interference cancellation. The system 100 removes the estimated echo/interference signal by subtracting the estimated echo/interference signal from the target signal, thus cancelling the estimated echo/interference signal. This cancellation may be referred to as "removing," "subtracting" or "cancelling" interchangeably without departing from the disclosure. Additionally or alternatively, in some examples the disclosure may refer to removing an acoustic echo, ambient acoustic noise and/or acoustic interference. As the acoustic echo, the ambient acoustic noise and/or the acoustic interference are included in the input audio data and the system 100 does not receive discrete audio signals corresponding to these portions of the input audio data, removing the acoustic echo/noise/interference corresponds to estimating the acoustic echo/noise/interference and cancelling the estimate from the target signal.

In some examples, the device 102 may include an adaptive beamformer 150 that may perform audio beamforming on the echo signals y(n) 120 to determine target signals 122. For example, the adaptive beamformer 150 may include a fixed beamformer (FBF) 160 and/or an adaptive noise canceller (ANC) 170. The FBF 160 may be configured to form a beam in a specific direction so that a target signal is passed and all other signals are attenuated, enabling the adaptive beamformer 150 to select a particular direction (e.g., directional portion of the echo reference signals y(n)

120 or the combined echo reference signal). In contrast, a blocking matrix may be configured to form a null in a specific direction so that the target signal is attenuated and all other signals are passed. The adaptive beamformer 150 may generate fixed beamforms (e.g., outputs of the FBF 160) or may generate adaptive beamforms using a Linearly Constrained Minimum Variance (LCMV) beamformer, a Minimum Variance Distortionless Response (MVDR) beamformer or other beamforming techniques. For example, the adaptive beamformer 150 may receive audio input, determine six beamforming directions and output six fixed beamform outputs and six adaptive beamform outputs. In some examples, the adaptive beamformer 150 may generate six fixed beamform outputs, six LCMV beamform outputs and six MVDR beamform outputs, although the disclosure is not limited thereto. Using the adaptive beamformer 150 and techniques discussed below, the device 102 may determine the target signals 122 to pass to a MC-AEC 108*a*. However, while FIG. 1A illustrates the device 102 including the adaptive beamformer 150, a traditional AEC system may perform AEC without the adaptive beamformer 150 without departing from the present disclosure.

In some examples, the system 100 may perform acoustic echo cancellation for each microphone 118 (e.g., 118*a* and 118*b*) to generate error signals 128. Thus, the MC-AEC 108*a* corresponds to the first microphone 118*a* and generates a first error signal $e_1(n)$ 128*a*, a second acoustic echo canceller would correspond to the second microphone 118*b* and generate a second error signal $e_2(n)$ 128*b*, and so on for each of the microphones 118. The first error signal $e_1(n)$ 128*a* and the second error signal $e_2(n)$ 128*b* (and additional error signals 128 for additional microphones) may be combined as an output (i.e., audio out 129). However, the disclosure is not limited thereto and the system 100 may perform acoustic echo cancellation for each target signal of the target signals 122. Thus, the system 100 may perform acoustic echo cancellation for a single target signal and generate a signal error signal e(n) 128 and a single audio output 129. Additionally or alternatively, each microphone 118 may correspond to a discrete MC-AEC 108*a*. However, the disclosure is not limited thereto and a single MC-AEC 108 may perform acoustic echo cancellation for all of the microphones 118 without departing from the disclosure.

The MC-AEC 108*a* may subtract the estimated echo signal 126*a* (e.g., estimate of reproduced sounds) from the target signals 122 (e.g., reproduced sounds and additional sounds such as speech) to cancel the reproduced sounds and isolate the additional sounds (e.g., speech) as audio outputs 129. As the estimated echo signal 126*a* is generated based on the reference signals 112, the audio outputs 129 of the MC-AEC 108*a* are examples of a conventional AEC system.

To illustrate, in some examples the device 102 may use outputs of the FBF 160 as the target signals 122. For example, the outputs of the FBF 160 may be shown in equation (4):

$$\text{Target}=s+z+\text{noise} \quad [4]$$

where s is speech (e.g., the additional sounds), z is an echo from the signal sent to the loudspeaker (e.g., the reproduced sounds) and noise is additional noise that is not associated with the speech or the echo. In order to attenuate the echo (z), the device 102 may use outputs of the playback reference logic 103 (e.g., reference signals 123) to generate the estimated echo signal 126*a*, which may be shown in equation (5):

$$\text{Estimated Echo}=z+\text{noise} \quad [5]$$

By subtracting the estimated echo signal 126*a* from the target signals 122, the device 102 may cancel the acoustic echo and generate the audio outputs 129 including only the speech and some noise. The device 102 may use the audio outputs 129 to perform speech recognition processing on the speech to determine a command and may execute the command. For example, the device 102 may determine that the speech corresponds to a command to play music and the device 102 may play music in response to receiving the speech.

As illustrated in FIG. 1A, the device 102 may receive (130) audio input and may perform (132) audio beamforming. For example, the device 102 may receive the audio input from the microphones 118 and may perform audio beamforming to separate the audio input into separate directions. The device 102 may determine (134) target signals 122, which may include a single target signal (e.g., first echo signal $y_1(n)$ 120*a* received from a microphone 118) or may include multiple target signals (e.g., target signal 122*a*, target signal 122*b*, . . . target signal 122*n*) that may be generated using the FBF 160 or other components of the adaptive beamformer 150.

The device 102 may generate (136) an estimate of the echo signal (e.g., estimated echo signal 126*a*), which may be based on the reference signals 112 sent to the loudspeakers 114. For example, the device 102 may compensate for distortion, variable delay, drift, skew and/or frequency offset, as discussed above with regard to the playback reference logic 103, so that the reference signals 123 are aligned with the echo signals 120 input to the microphones 118, and may use adaptive filters to generate the estimated echo signal 126*a*.

The device 102 may cancel (138) an echo from the target signals 122 by subtracting the estimated echo signals 126 in order to isolate speech or additional sounds and may output (140) first audio data including the speech or additional sounds. For example, the device 102 may cancel music (e.g., reproduced sounds) played over the loudspeakers 114 to isolate a voice command input to the microphones 118. As the reference signals 123 are generated based on the reference signals 112, the first audio data is an example of a conventional AEC system.

The MC-AEC 108*a* calculates frequency domain versions of the estimated transfer functions $\hat{h}_1(n)$ and $\hat{h}_2(n)$ using short term adaptive filter coefficients H(k,r) that are used by adaptive filters. To correctly calculate the estimated transfer functions $\hat{h}(n)$, the device 102 may use a step-size controller 190 that determines a step-size μ with which to adjust the estimated transfer functions $\hat{h}(n)$.

In conventional AEC systems operating in the time domain, the adaptive filter coefficients are derived using least mean squares (LMS), normalized least mean squares (NLMS) or stochastic gradient algorithms, which use an instantaneous estimate of a gradient to update an adaptive weight vector at each time step. With this notation, the LMS algorithm can be iteratively expressed in the usual form:

$$h_{new}=h_{old}+\mu*e*x \quad [6]$$

where $h_{new}$ is an updated transfer function, $h_{old}$ is a transfer function from a prior iteration, μ is the step size between samples, e is an error signal, and x is a reference signal. For example, the MC-AEC 108*a* may generate the first error signal $e_1(n)$ 128*a* using first filter coefficients for the adaptive filters (corresponding to a previous transfer function $h_{old}$), the step-size controller 190 may use the first error signal $e_1(n)$ 128*a* to determine a step-size value μ, and the adaptive filters may use the step-size value μ to generate second filter coefficients from the first filter coefficients (corresponding to a new transfer function $h_{new}$). Thus, the adjustment between the previous transfer function $h_{old}$ and new transfer function $h_{new}$ is proportional to the step-size value μ. If the step-size value is closer to one, the adjustment is larger, whereas if the step-size value is closer to zero, the adjustment is smaller.

Applying such adaptation over time (i.e., over a series of samples), it follows that the error signal $e_1(n)$ 128*a* (e.g., e) should eventually converge to zero for a suitable choice of the step size μ (assuming that the sounds captured by the microphone 118*a* correspond to sound entirely based on the references signals 112*a* and 112*b* rather than additional ambient noises, such that the estimated echo signal $\hat{y}_1(n)$ 126*a* cancels out the echo signal $y_1(n)$ 120*a*). However, $e \rightarrow 0$ does not always imply that $h-\hat{h} \rightarrow 0$, where the estimated transfer function $\hat{h}$ cancelling the corresponding actual transfer function h is the goal of the adaptive filter. For example, the estimated transfer functions $\hat{h}(n)$ may cancel a particular string of samples, but is unable to cancel all signals, e.g., if the string of samples has no energy at one or more frequencies. As a result, effective cancellation may be intermittent or transitory. Having the estimated transfer function $\hat{h}$ approximate the actual transfer function h is the goal of single-channel echo cancellation, and becomes even more critical in the case of multichannel echo cancellers that require estimation of multiple transfer functions.

The step-size controller 190 may control a step-size parameter μ used by MC-AECs 108. For example, the step-size controller 190 may receive microphone signal(s) 120 (e.g., 120*a*), estimated echo signals 126 (e.g., 126*a*, 126*b* and 126*c*), error signal(s) 128 (e.g., 128*a*) and/or other signals generated or used by the MC-AEC 108*a* and may determine step-size values $\mu_p$ and provide the step-size values $\mu_p$ to the MC-AEC 108*a* to be used by adaptive filters (e.g., echo estimation filter blocks 124) included in the MC-AEC 108*a*. The step-size values $\mu_p$ may be determined for individual channels (e.g., reference signals 120) and tone indexes (e.g., frequency subbands) on a frame-by-frame basis. The MC-AEC 108*a* may use the step-size values $\mu_p$ to perform acoustic echo cancellation and generate a first error signal 128*a*, as discussed in greater detail above. Thus, the MC-AEC 108*a* may generate the first error signal 128*a* using first filter coefficients for the adaptive filters, the step-size controller 190 may use the first error signal 128*a* to determine step-size values $\mu_p$ and the adaptive filters may use the step-size values $\mu_p$ to generate second filter coefficients from the first filter coefficients.

The system 100 may use short-time Fourier transform-based frequency-domain acoustic echo cancellation (STFT AEC) to determine the step-size value $\mu_p$. The following high level description of STFT AEC refers to echo signal y 120, which is a time-domain signal comprising an echo from at least one loudspeaker 114 and is the output of a microphone 118. The reference signal x 112 is a time-domain audio signal that is sent to and output by a loudspeaker 114. The variables X and Y correspond to a Short Time Fourier Transform of x and y respectively, and thus represent frequency-domain signals. A short-time Fourier transform (STFT) is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "m" is a frequency index.

Figure 2A:
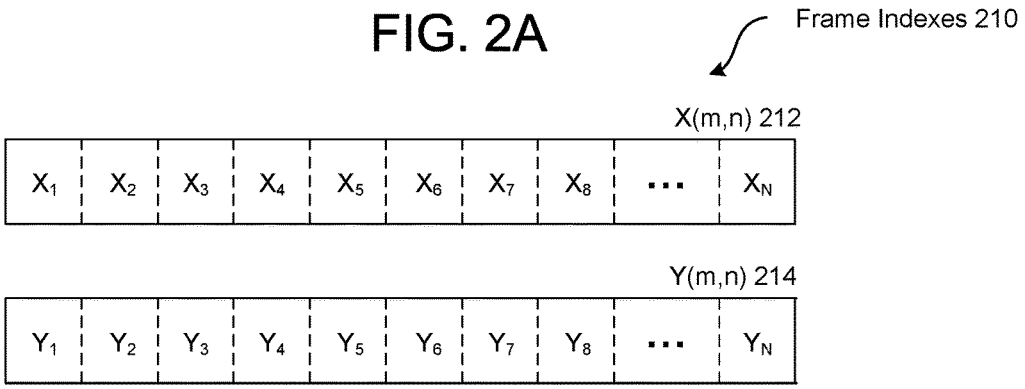
FIGS. 2A-2C illustrate examples of channel indexes, tone indexes and frame indexes.

FIG. 2A illustrates an example of frame indexes 210 including reference values X(m,n) 212 and input values Y(m,n) 214. For example, the system 100 may apply a short-time Fourier transform (STFT) to the time-domain reference signal x(n) 112, producing the frequency-domain reference values X(m,n) 212, where the tone index "m" ranges from 0 to M and "n" is a frame index ranging from 0 to N. The system 100 may also apply an STFT to the time domain signal y(n) 120, producing frequency-domain input values Y(m,n) 214. As illustrated in FIG. 2A, the history of the values across iterations is provided by the frame index "n", which ranges from 1 to N and represents a series of samples over time.

Figure 2B:
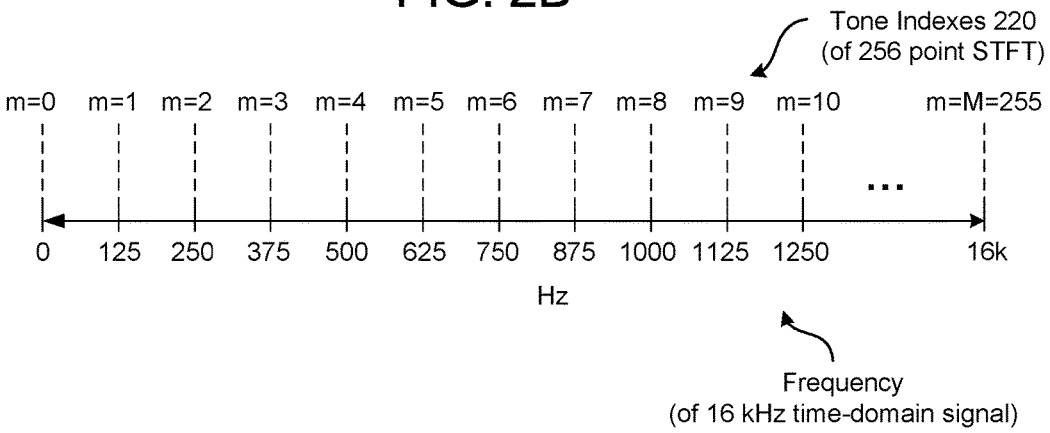

FIG. 2B illustrates an example of performing an M-point STFT on a time-domain signal. As illustrated in FIG. 2B, if a 256-point STFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point STFT corresponds to a frequency range (e.g., subband) in the 16 kHz time-domain signal. While FIG. 2B illustrates the frequency range being divided into 256 different subbands (e.g., tone indexes), the disclosure is not limited thereto and the system 100 may divide the frequency range into M different subbands. While FIG. 2B illustrates the tone index 220 being generated using a Short-Time Fourier Transform (STFT), the disclosure is not limited thereto. Instead, the tone index 220 may be generated using Fast Fourier Transform (FFT), generalized Discrete Fourier Transform (DFT) and/or other transforms known to one of skill in the art (e.g., discrete cosine transform, non-uniform filter bank, etc.).

Given a signal z[n], the STFT Z(m,n) of z[n] is defined by $$Z(m,n) = \sum_{k=0}^{K-1} Win(k) * z(k + n * \mu) * e^{-2pi*m*k/K} \quad [7.1]$$

Where, Win(k) is a window function for analysis, m is a frequency index, n is a frame index, μ is a step-size (e.g., hop size), and K is an FFT size. Hence, for each block (at frame index n) of K samples, the STFT is performed which produces K complex tones X(m,n) corresponding to frequency index m and frame index n.

Referring to the input signal y(n) 120 from the microphone 118, Y(m,n) has a frequency domain STFT representation:

$$Y(m,n) = \sum_{k=0}^{K-1} Win(k) * y(k + n * \mu) * e^{-2pi*m*k/K} \quad [7.2]$$

Referring to the reference signal x(n) 112 to the loudspeaker 114, X(m,n) has a frequency domain STFT representation:

$$X(m, n) = \sum_{k=0}^{K-1} Win(k) * x(k + n * \mu) * e^{-2pi*m*k/K} \quad [7.3]$$

The system 100 may determine the number of tone indexes 220 and the step-size controller 104 may determine a step-size value for each tone index 220 (e.g., subband). Thus, the frequency-domain reference values X(m,n) 212 and the frequency-domain input values Y(m,n) 214 are used to determine individual step-size parameters for each tone index "m," generating individual step-size values on a frame-by-frame basis. For example, for a first frame index "1," the step-size controller 104 may determine a first step-size parameter μ(m) for a first tone index "m," a second step-size parameter μ(m+1) for a second tone index "m+1," a third step-size parameter μ(m+2) for a third tone index "m+2" and so on. The step-size controller 104 may determine updated step-size parameters for a second frame index "2," a third frame index "3," and so on.

Figure 2C:
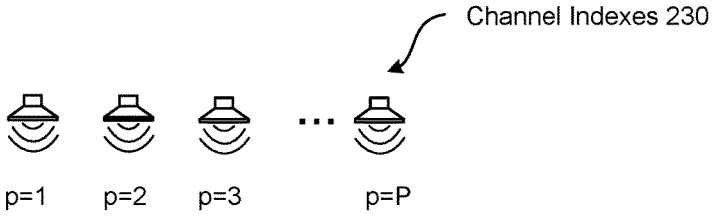

The system 100 may include a multi-channel AEC, with a first channel p (e.g., reference signal 112*a*) corresponding to a first loudspeaker 114*a*, a second channel (p+1) (e.g., reference signal 112*b*) corresponding to a second loudspeaker 114*b*, and so on until a final channel (P) (e.g., reference signal 112*c*) that corresponds to loudspeaker 114*c*. FIG. 2C illustrates channel indexes 230 including a plurality of channels from channel p to channel P. Thus, while FIG. 1A illustrates two channels (e.g., reference signals 112), the disclosure is not limited thereto and the number of channels may vary. For the purposes of discussion, an example of system 100 includes "P" loudspeakers 114 (P>1) and a separate microphone array system (microphones 118) for hands free near-end/far-end multichannel AEC applications.

For each channel of the channel indexes (e.g., for each loudspeaker 114), the step-size controller 190 may perform the steps discussed above to determine a step-size value μ for each tone index 220 on a frame-by-frame basis. Thus, a first reference frame index 210*a* and a first input frame index 214*a* corresponding to a first channel may be used to determine a first plurality of step-size values μ, a second reference frame index 210*b* and a second input frame index 214*b* corresponding to a second channel may be used to determine a second plurality of step-size values μ, and so on. The step-size controller 104 may provide the step-size values μ to adaptive filters for updating filter coefficients used to perform the acoustic echo cancellation (AEC). For example, the first plurality of step-size values μ may be provided to a first MC-AEC 108*a*, the second plurality of step-size values may be provided to a second MC-AEC 108*b*, and so on. The first MC-AEC 108*a* may use the first plurality of step-size values μ to update filter coefficients from previous filter coefficients, as discussed above with regard to Equation 4. For example, an adjustment between the previous transfer function $h_{old}$ and new transfer function $h_{new}$ is proportional to the step-size value μ. If the step-size value μ is closer to one, the adjustment is larger, whereas if the step-size value μ is closer to zero, the adjustment is smaller.

Calculating the step-size values μ for each channel/tone index/frame index allows the system 100 to improve steady-state error, reduce a sensitivity to local speech disturbance and improve a convergence rate of the MC-AEC 108*a*. For example, the step-size value μ may be increased when the error signal 128 increases (e.g., the echo signal 120 and the estimated echo signal 126 diverge) to increase a convergence rate and reduce a convergence period. Similarly, the step-size value μ may be decreased when the error signal 128 decreases (e.g., the echo signal 120 and the estimated echo signal 126 converge) to reduce a rate of change in the transfer functions and therefore more accurately estimate the estimated echo signal 126.

Figure 3:
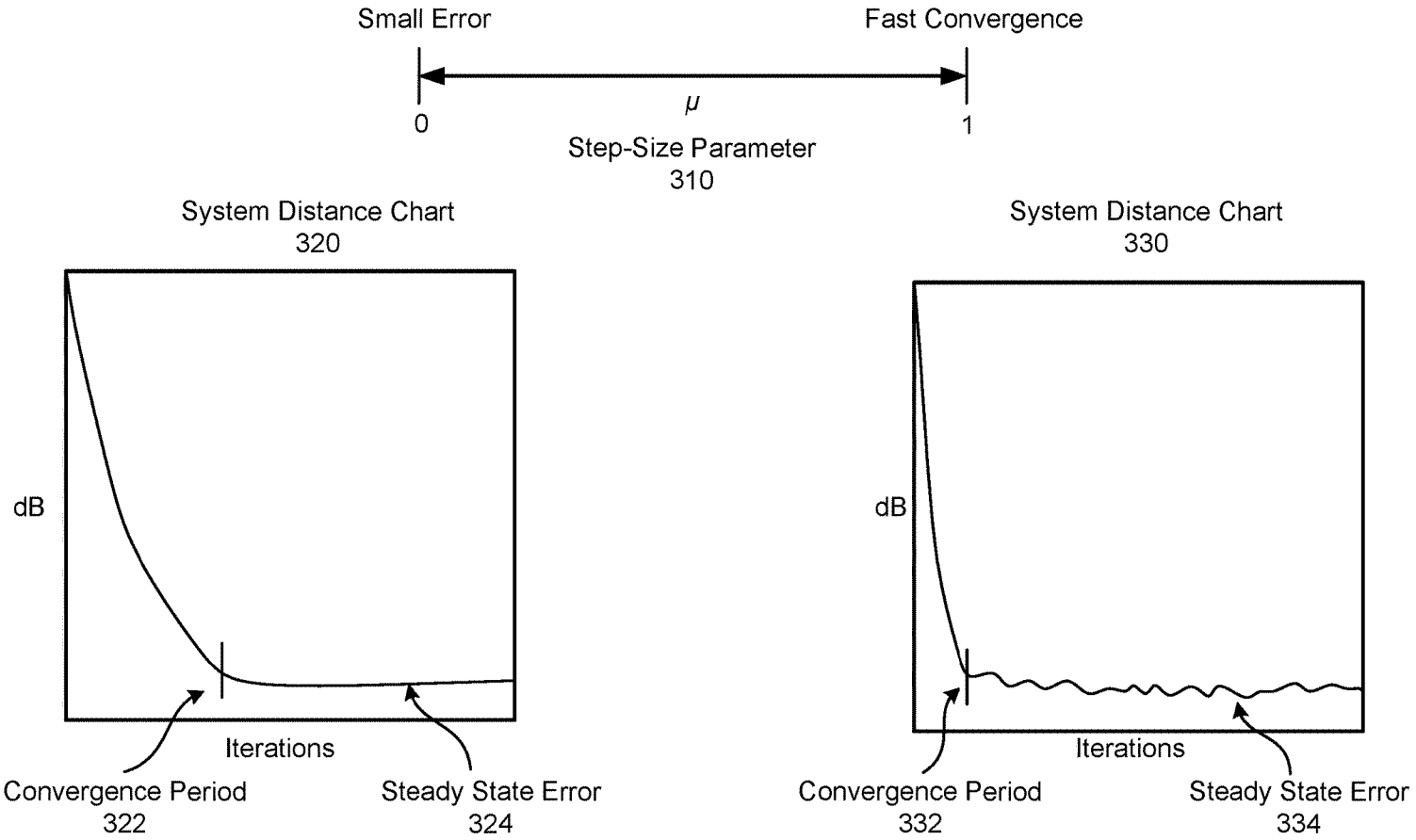
FIG. 3 illustrates examples of convergence periods and steady state error associated with different step-size parameters.

FIG. 3 illustrates examples of convergence periods and steady state error associated with different step-size parameters μ. As illustrated in FIG. 3, a step-size parameter μ 310 may vary between a lower bound (e.g., 0) and an upper bound (e.g., 1). A system distance measures the similarity between the estimated impulse response and the true impulse response. Thus, a relatively small step-size value μ corresponds to system distance chart 320, which has a relatively long convergence period 322 (e.g., time until the estimated echo signal 125 matches the echo signal 120) but relatively low steady state error 324 (e.g., the estimated echo signal 125 accurately estimates the echo signal 120). In contrast, a relatively large step-size value μ corresponds to system distance chart 330, which has a relatively short convergence period 332 and a relatively large steady state error 334. While the large step-size value μ quickly matches the estimated echo signal 125 to the echo signal 120, the large step-size value μ prevents the estimated echo signal 125 from accurately estimating the echo signal 120 over time due to misadjustments caused by noise sensitivity and/or near-end speech (e.g., speech from a loudspeaker in proximity to the microphone 118).

Figure 1B:
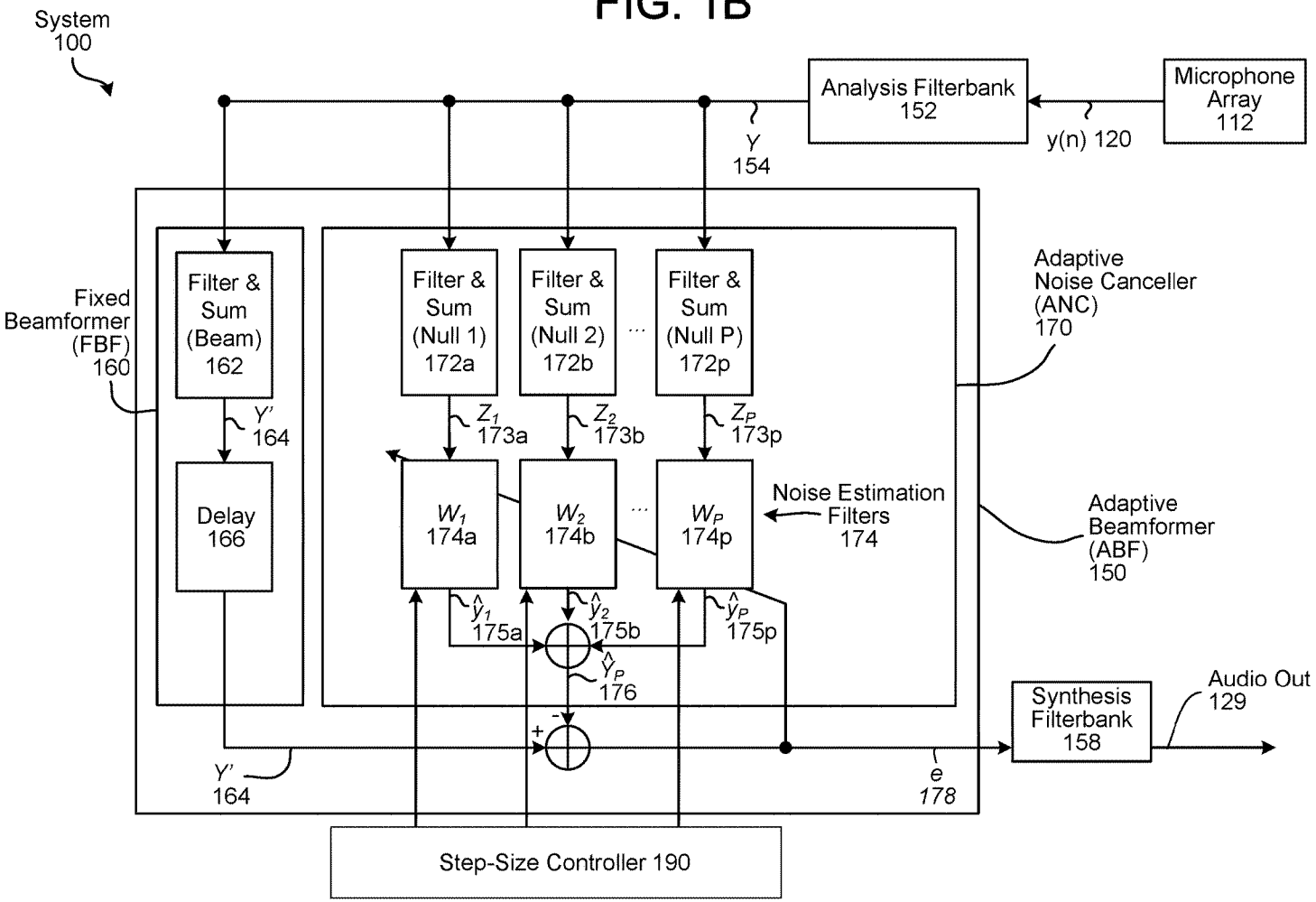

FIG. 1B illustrates a high-level conceptual block diagram of echo-cancellation aspects of an AEC system 100 using an adaptive interference canceller. Some of the components are identical to the example illustrated in FIG. 1A and therefore a corresponding description may be omitted. The adaptive beamformer 150 may be used in place of the MC-AEC 108*a* illustrated in FIG. 1A, generating an audio output 129 without regard to the reference signals 112. As discussed above with regard to FIG. 1A, the device 102 may use the audio outputs 129 to perform speech recognition processing on the speech to determine a command and may execute the command. For example, the device 102 may determine that the speech corresponds to a command to play music and the device 102 may play music in response to receiving the speech.

In some examples, the device 102 may associate specific directions with the reproduced sounds and/or speech based on features of the signal sent to the loudspeaker. Examples of features includes power spectrum density, peak levels, pause intervals or the like that may be used to identify the signal sent to the loudspeaker and/or propagation delay between different signals. For example, the adaptive beamformer 150 may compare the signal sent to the loudspeaker with a signal associated with a first direction to determine if the signal associated with the first direction includes reproduced sounds from the loudspeaker. When the signal associated with the first direction matches the signal sent to the loudspeaker, the device 102 may associate the first direction with a wireless loudspeaker. When the signal associated with the first direction does not match the signal sent to the loudspeaker, the device 102 may associate the first direction with speech, a speech position, a person or the like.

The device 102 may determine a speech position (e.g., near end talk position) associated with speech and/or a person speaking. For example, the device 102 may identify the speech, a person and/or a position associated with the speech/person using audio data (e.g., audio beamforming when speech is recognized), video data (e.g., facial recognition) and/or other inputs known to one of skill in the art. The device 102 may determine target signals 122, which may include a single target signal (e.g., echo signal 120 received from a microphone 118) or may include multiple target signals (e.g., target signal 122*a*, target signal 122*b*, . . . target signal 122*n*) that may be generated using the FBF 160 or other components of the adaptive beamformer 150. In some examples, the device 102 may determine the target signals based on the speech position. The device 102 may determine an adaptive reference signal based on the speech position and/or the audio beamforming. For example, the device 102 may associate the speech position with a target signal and may select an opposite direction as the adaptive reference signal.

The device 102 may determine the target signals and the adaptive reference signal using multiple techniques, which are discussed in greater detail below. For example, the device 102 may use a first technique when the device 102 detects a clearly defined loudspeaker signal, a second technique when the device 102 doesn't detect a clearly defined loudspeaker signal but does identify a speech position and/or a third technique when the device 102 doesn't detect a clearly defined loudspeaker signal or a speech position. Using the first technique, the device 102 may associate the clearly defined loudspeaker signal with the adaptive reference signal and may select any or all of the other directions as the target signal. For example, the device 102 may generate a single target signal using all of the remaining directions for a single loudspeaker or may generate multiple target signals using portions of remaining directions for multiple loudspeakers. Using the second technique, the device 102 may associate the speech position with the target signal and may select an opposite direction as the adaptive reference signal. Using the third technique, the device 102 may select multiple combinations of opposing directions to generate multiple target signals and multiple adaptive reference signals.

The device 102 may cancel an acoustic echo from the target signal by subtracting the adaptive reference signal to isolate speech or additional sounds and may output second audio data including the speech or additional sounds. For example, the device 102 may cancel music (e.g., reproduced sounds) played over the loudspeakers 114 to isolate a voice command input to the microphones 118. As the adaptive reference signal is generated based on the echo signals 120 input to the microphones 118, the second audio data is an example of an ARSSA AEC system.

FIG. 1B illustrates a high-level conceptual block diagram of a system 100 configured to perform beamforming using a fixed beamformer and an adaptive noise canceller that can cancel noise from particular directions using adaptively controlled coefficients which can adjust how much noise is cancelled from particular directions. As shown in FIG. 1B, the system 100 generates audio signals Y 154 from audio data 120 generated by a microphone array 118. For example, the audio data 120 is received from the microphone array 118 and processed by an analysis filterbank 152, which converts the audio data 120 from the time domain into the frequency/sub-band domain, where $x_m$ denotes the time-domain microphone data for the mth microphone, m=1, . . . , M. The filterbank 152 divides the resulting audio signals into multiple adjacent frequency bands, resulting in audio signals Y 154. The system 100 then operates a fixed beamformer (FBF) to amplify a first audio signal from a desired direction to obtain an amplified first audio signal Y' 164. For example, the audio signal Y 154 may be fed into a fixed beamformer (FBF) component 160, which may include a filter and sum component 162 associated with the "beam" (e.g., look direction). The FBF 160 may be a separate component or may be included in another component such as a general adaptive beamformer (ABF) 150. As explained below, the FBF 160 may operate a filter and sum component 162 to isolate the first audio signal from the direction of an audio source.

The system 100 may also operate an adaptive noise canceller (ANC) 170 to amplify audio signals from directions other than the direction of an audio source (e.g., non-look directions). Those audio signals represent noise signals so the resulting amplified audio signals from the ANC 170 may be referred to as noise reference signals 173 (e.g., $Z_1$-$Z_P$), discussed further below. The ANC 170 may include filter and sum components 172 which may be used to generate the noise reference signals 173. For ease of illustration, the filter and sum components 172 may also be referred to as nullformers 172 or nullformer blocks 172 without departing from the disclosure. The system 100 may then weight the noise reference signals 173, for example using adaptive filters (e.g., noise estimation filter blocks 174) discussed below. The system may combine the weighted noise reference signals 175 (e.g., $\hat{y}_1$-$\hat{y}_p$) into a combined (weighted) noise reference signal 176 (e.g., $\hat{Y}_P$). Alternatively the system may not weight the noise reference signals 173 and may simply combine them into the combined noise reference signal 176 without weighting. The system may then subtract the combined noise reference signal 176 from the amplified first audio signal Y' 164 to obtain a difference (e.g., error signal 178). The system may then output that difference, which represents the desired output audio signal with the noise cancelled. The diffuse noise is cancelled by the FBF when determining the amplified first audio signal Y' 164 and the directional noise is cancelled when the combined noise reference signal 176 is subtracted. The system may also use the difference to create updated weights (for example for adaptive filters included in the noise estimation filter blocks 174) that may be used to weight future audio signals. The step-size controller 190 may be used modulate the rate of adaptation from one weight to an updated weight.

In this manner noise reference signals are used to adaptively estimate the noise contained in the output of the FBF signal using the noise estimation filter blocks 174. This noise estimate (e.g., combined noise reference signal $\hat{Y}_P$ 176 output by ANC 170) is then subtracted from the FBF output signal (e.g., amplified first audio signal Y' 164) to obtain the final ABF output signal (e.g., error signal 178). The ABF output signal (e.g., error signal 178) is also used to adaptively update the coefficients of the noise estimation filters. Lastly, the system 100 uses a robust step-size controller 190 to control the rate of adaptation of the noise estimation filters.

Further details of the system operation are described below following a discussion of directionality in reference to FIGS. 4-8.

The device 102 may include a microphone array having multiple microphones 118 that are laterally spaced from each other so that they can be used by audio beamforming components to produce directional audio signals. The microphones 118 may, in some instances, be dispersed around a perimeter of the device 102 in order to apply beampatterns to audio signals based on sound captured by the microphone(s) 118. For example, the microphones 118 may be positioned at spaced intervals along a perimeter of the device 102, although the present disclosure is not limited thereto. In some examples, the microphone(s) 118 may be spaced on a substantially vertical surface of the device 102 and/or a top surface of the device 102. Each of the microphones 118 is omnidirectional, and beamforming technology is used to produce directional audio signals based on signals from the microphones 118. In other embodiments, the microphones may have directional audio reception, which may remove the need for subsequent beamforming.

In various embodiments, the microphone array may include greater or less than the number of microphones 118 shown. Loudspeaker(s) (not illustrated) may be located at the bottom of the device 102, and may be configured to emit sound omnidirectionally, in a 360 degree pattern around the device 102. For example, the loudspeaker(s) may comprise a round loudspeaker element directed downwardly in the lower part of the device 102.

Using the plurality of microphones 118 the device 102 may employ beamforming techniques to isolate desired sounds for purposes of converting those sounds into audio signals for speech processing by the system. Beamforming is the process of applying a set of beamformer coefficients to audio signal data to create beampatterns, or effective directions of gain or attenuation. In some implementations, these volumes may be considered to result from constructive and destructive interference between signals from individual microphones in a microphone array.

The device 102 may include an adaptive beamformer 150 that may include one or more audio beamformers or beamforming components that are configured to generate an audio signal that is focused in a direction from which user speech has been detected. More specifically, the beamforming components may be responsive to spatially separated microphone elements of the microphone array to produce directional audio signals that emphasize sounds originating from different directions relative to the device 102, and to select and output one of the audio signals that is most likely to contain user speech.

Audio beamforming, also referred to as audio array processing, uses a microphone array having multiple microphones that are spaced from each other at known distances. Sound originating from a source is received by each of the microphones. However, because each microphone is potentially at a different distance from the sound source, a propagating sound wave arrives at each of the microphones at slightly different times. This difference in arrival time results in phase differences between audio signals produced by the microphones. The phase differences can be exploited to enhance sounds originating from chosen directions relative to the microphone array.

Beamforming uses signal processing techniques to combine signals from the different microphones so that sound signals originating from a particular direction are emphasized while sound signals from other directions are deemphasized. More specifically, signals from the different microphones are combined in such a way that signals from a particular direction experience constructive interference, while signals from other directions experience destructive interference. The parameters used in beamforming may be varied to dynamically select different directions, even when using a fixed-configuration microphone array.

A given beampattern may be used to selectively gather signals from a particular spatial location where a signal source is present. The selected beampattern may be configured to provide gain or attenuation for the signal source. For example, the beampattern may be focused on a particular user's head allowing for the recovery of the user's speech while attenuating noise from an operating air conditioner that is across the room and in a different direction than the user relative to a device that captures the audio signals.

Such spatial selectivity by using beamforming allows for the rejection or attenuation of undesired signals outside of the beampattern. The increased selectivity of the beampattern improves signal-to-noise ratio for the audio signal. By improving the signal-to-noise ratio, the accuracy of speaker recognition performed on the audio signal is improved.

The processed data from the beamformer module may then undergo additional filtering or be used directly by other modules. For example, a filter may be applied to processed data which is acquiring speech from a user to remove residual audio noise from a machine running in the environment.

Figure 4:
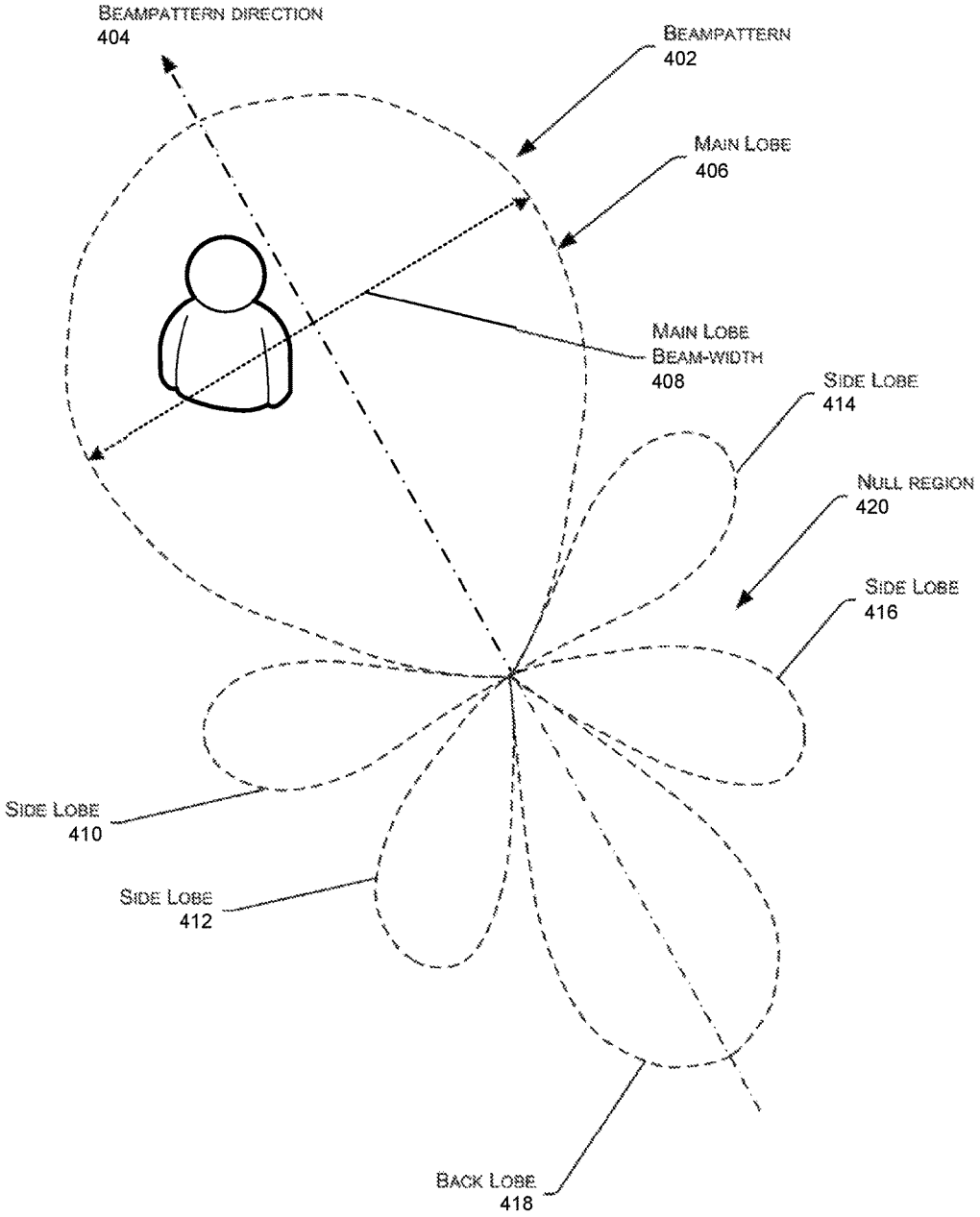
FIG. 4 is an illustration of beamforming according to embodiments of the present disclosure.

FIG. 4 is an illustration of beamforming according to embodiments of the present disclosure. FIG. 4 illustrates a schematic of a beampattern 402 formed by applying beamforming coefficients to signal data acquired from a microphone array of the device 102. As mentioned above, the beampattern 402 results from the application of a set of beamformer coefficients to the signal data. The beampattern generates directions of effective gain or attenuation. In this illustration, the dashed line indicates isometric lines of gain provided by the beamforming coefficients. For example, the gain at the dashed line here may be +12 decibels (dB) relative to an isotropic microphone.

The beampattern 402 may exhibit a plurality of lobes, or regions of gain, with gain predominating in a particular direction designated the beampattern direction 404. A main lobe 406 is shown here extending along the beampattern direction 404. A main lobe beam-width 408 is shown, indicating a maximum width of the main lobe 406. In this example, the beampattern 402 also includes side lobes 410, 412, 414, and 416. Opposite the main lobe 406 along the beampattern direction 404 is the back lobe 418. Disposed around the beampattern 402 are null regions 420. These null regions are areas of attenuation to signals. In the example, the person 10 resides within the main lobe 406 and benefits from the gain provided by the beampattern 402 and exhibits an improved SNR ratio compared to a signal acquired with non-beamforming. In contrast, if the person 10 were to speak from a null region, the resulting audio signal may be significantly reduced. As shown in this illustration, the use of the beampattern provides for gain in signal acquisition compared to non-beamforming. Beamforming also allows for spatial selectivity, effectively allowing the system to "turn a deaf ear" on a signal which is not of interest. Beamforming may result in directional audio signal(s) that may then be processed by other components of the device 102 and/or system 100.

While beamforming alone may increase a signal-to-noise (SNR) ratio of an audio signal, combining known acoustic characteristics of an environment (e.g., a room impulse response (RIR)) and heuristic knowledge of previous beampattern lobe selection may provide an even better indication of a speaking user's likely location within the environment. In some instances, a device includes multiple microphones that capture audio signals that include user speech. As is known and as used herein, "capturing" an audio signal includes a microphone transducing audio waves of captured sound to an electrical signal and a codec digitizing the signal. The device may also include functionality for applying different beampatterns to the captured audio signals, with each beampattern having multiple lobes. By identifying lobes most likely to contain user speech using the combination discussed above, the techniques enable devotion of additional processing resources of the portion of an audio signal most likely to contain user speech to provide better echo canceling and thus a cleaner SNR ratio in the resulting processed audio signal.

To determine a value of an acoustic characteristic of an environment (e.g., an RIR of the environment), the device 102 may emit sounds at known frequencies (e.g., chirps, text-to-speech audio, music or spoken word content playback, etc.) to measure a reverberant signature of the environment to generate an RIR of the environment. Measured over time in an ongoing fashion, the device may be able to generate a consistent picture of the RIR and the reverberant qualities of the environment, thus better enabling the device to determine or approximate where it is located in relation to walls or corners of the environment (assuming the device is stationary). Further, if the device is moved, the device may be able to determine this change by noticing a change in the RIR pattern. In conjunction with this information, by tracking which lobe of a beampattern the device most often selects as having the strongest spoken signal path over time, the device may begin to notice patterns in which lobes are selected. If a certain set of lobes (or microphones) is selected, the device can heuristically determine the user's typical speaking location in the environment. The device may devote more CPU resources to digital signal processing (DSP) techniques for that lobe or set of lobes. For example, the device may run acoustic echo cancelation (AEC) at full strength across the three most commonly targeted lobes, instead of picking a single lobe to run AEC at full strength. The techniques may thus improve subsequent automatic speech recognition (ASR) and/or speaker recognition results as long as the device is not rotated or moved. And, if the device is moved, the techniques may help the device to determine this change by comparing current RIR results to historical ones to recognize differences that are significant enough to cause the device to begin processing the signal coming from all lobes approximately equally, rather than focusing only on the most commonly targeted lobes.

By focusing processing resources on a portion of an audio signal most likely to include user speech, the SNR of that portion may be increased as compared to the SNR if processing resources were spread out equally to the entire audio signal. This higher SNR for the most pertinent portion of the audio signal may increase the efficacy of the device 102 when performing speaker recognition on the resulting audio signal.

Using the beamforming and directional based techniques above, the system may determine a direction of detected audio relative to the audio capture components. Such direction information may be used to link speech/a recognized speaker identity to video data as described below.

Figure 5B:
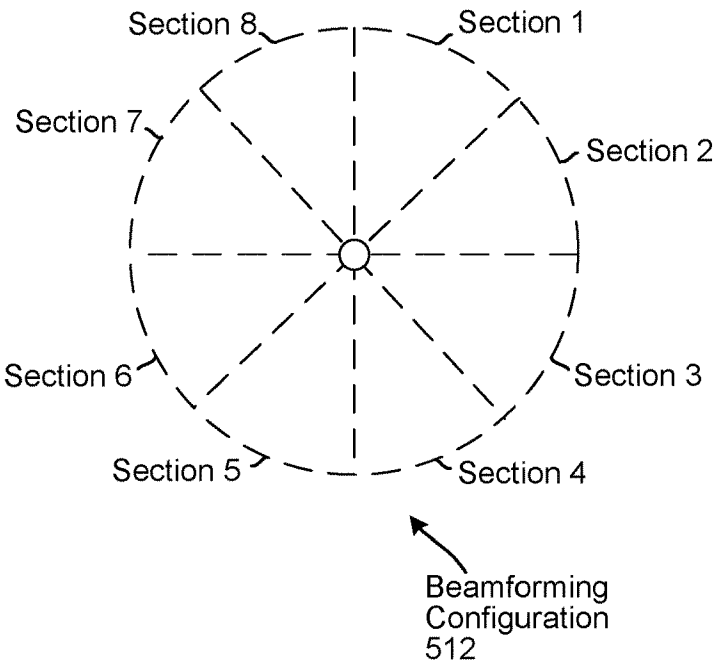
FIGS. 5A-5B illustrate examples of beamforming configurations according to embodiments of the present disclosure.
Figure 5A:
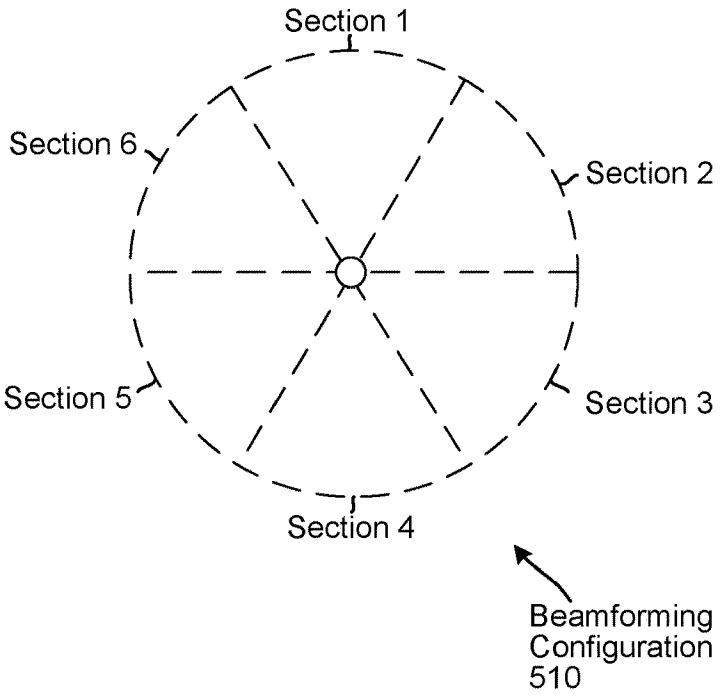

FIGS. 5A-5B illustrate examples of beamforming configurations according to embodiments of the present disclosure. As illustrated in FIG. 5A, the device 102 may perform beamforming to determine a plurality of portions or sections of audio received from a microphone array (e.g., directional portions). FIG. 5A illustrates a beamforming configuration 510 including six portions or sections (e.g., Sections 1-6). For example, the device 102 may include six different microphones, may divide an area around the device 102 into six sections or the like. However, the present disclosure is not limited thereto and the number of microphones in the microphone array and/or the number of portions/sections in the beamforming may vary. As illustrated in FIG. 5B, the device 102 may generate a beamforming configuration 512 including eight portions/sections (e.g., Sections 1-8) without departing from the disclosure. For example, the device 102 may include eight different microphones, may divide the area around the device 102 into eight portions/sections or the like. Thus, the following examples may perform beamforming and separate an audio signal into eight different portions/sections, but these examples are intended as illustrative examples and the disclosure is not limited thereto.

The number of portions/sections generated using beamforming does not depend on the number of microphones in the microphone array. For example, the device 102 may include twelve microphones in the microphone array but may determine three portions, six portions or twelve portions of the audio data without departing from the disclosure. As discussed above, the adaptive beamformer 150 may generate fixed beamforms (e.g., outputs of the FBF 160) or may generate adaptive beamforms using a Linearly Constrained Minimum Variance (LCMV) beamformer, a Minimum Variance Distortionless Response (MVDR) beamformer or other beamforming techniques. For example, the adaptive beamformer 150 may receive the audio input, may determine six beamforming directions and output six fixed beamform outputs and six adaptive beamform outputs corresponding to the six beamforming directions. In some examples, the adaptive beamformer 150 may generate six fixed beamform outputs, six LCMV beamform outputs and six MVDR beamform outputs, although the disclosure is not limited thereto.

The device 102 may determine a number of wireless loudspeakers and/or directions associated with the wireless loudspeakers using the fixed beamform outputs. For example, the device 102 may localize energy in the frequency domain and clearly identify much higher energy in two directions associated with two wireless loudspeakers (e.g., a first direction associated with a first loudspeaker and a second direction associated with a second loudspeaker). In some examples, the device 102 may determine an existence and/or location associated with the wireless loudspeakers using a frequency range (e.g., 1 kHz to 3 kHz), although the disclosure is not limited thereto. In some examples, the device 102 may determine an existence and location of the wireless loudspeaker(s) using the fixed beamform outputs, may select a portion of the fixed beamform outputs as the target signal(s) and may select a portion of adaptive beamform outputs corresponding to the wireless loudspeaker(s) as the reference signal(s).

To perform echo cancellation, the device 102 may determine a target signal and a reference signal and may subtract the reference signal from the target signal to generate an output signal. For example, the loudspeaker may output audible sound associated with a first direction and a person may generate speech associated with a second direction. To cancel the audible sound output from the loudspeaker, the device 102 may select a first portion of audio data corresponding to the first direction as the reference signal and may select a second portion of the audio data corresponding to the second direction as the target signal. However, the disclosure is not limited to a single portion being associated with the reference signal and/or target signal and the device 102 may select multiple portions of the audio data corresponding to multiple directions as the reference signal/target signal without departing from the disclosure. For example, the device 102 may select a first portion and a second portion as the reference signal and may select a third portion and a fourth portion as the target signal.

Additionally or alternatively, the device 102 may determine more than one reference signal and/or target signal. For example, the device 102 may identify a first wireless loudspeaker and a second wireless loudspeaker and may determine a first reference signal associated with the first wireless loudspeaker and determine a second reference signal associated with the second wireless loudspeaker. The device 102 may generate a first output by subtracting the first reference signal from the target signal and may generate a second output by subtracting the second reference signal from the target signal. Similarly, the device 102 may select a first portion of the audio data as a first target signal and may select a second portion of the audio data as a second target signal. The device 102 may therefore generate a first output by subtracting the reference signal from the first target signal and may generate a second output by subtracting the reference signal from the second target signal.

The device 102 may determine reference signals, target signals and/or output signals using any combination of portions of the audio data without departing from the disclosure. For example, the device 102 may select first and second portions of the audio data as a first reference signal, may select a third portion of the audio data as a second reference signal and may select remaining portions of the audio data as a target signal. In some examples, the device 102 may include the first portion in a first reference signal and a second reference signal or may include the second portion in a first target signal and a second target signal. If the device 102 selects multiple target signals and/or reference signals, the device 102 may subtract each reference signal from each of the target signals individually (e.g., subtract reference signal 1 from target signal 1, subtract reference signal 1 from target signal 2, subtract reference signal 2 from target signal 1, etc.), may collectively subtract the reference signals from each individual target signal (e.g., subtract reference signals 1-2 from target signal 1, subtract reference signals 1-2 from target signal 2, etc.), subtract individual reference signals from the target signals collectively (e.g., subtract reference signal 1 from target signals 1-2, subtract reference signal 2 from target signals 1-2, etc.) or any combination thereof without departing from the disclosure.

The device 102 may select fixed beamform outputs or adaptive beamform outputs as the target signal(s) and/or the reference signal(s) without departing from the disclosure. In a first example, the device 102 may select a first fixed beamform output (e.g., first portion of the audio data determined using fixed beamforming techniques) as a reference signal and a second fixed beamform output as a target signal. In a second example, the device 102 may select a first adaptive beamform output (e.g., first portion of the audio data determined using adaptive beamforming techniques) as a reference signal and a second adaptive beamform output as a target signal. In a third example, the device 102 may select the first fixed beamform output as the reference signal and the second adaptive beamform output as the target signal. In a fourth example, the device 102 may select the first adaptive beamform output as the reference signal and the second fixed beamform output as the target signal. However, the disclosure is not limited thereto and further combinations thereof may be selected without departing from the disclosure.

Figure 6:
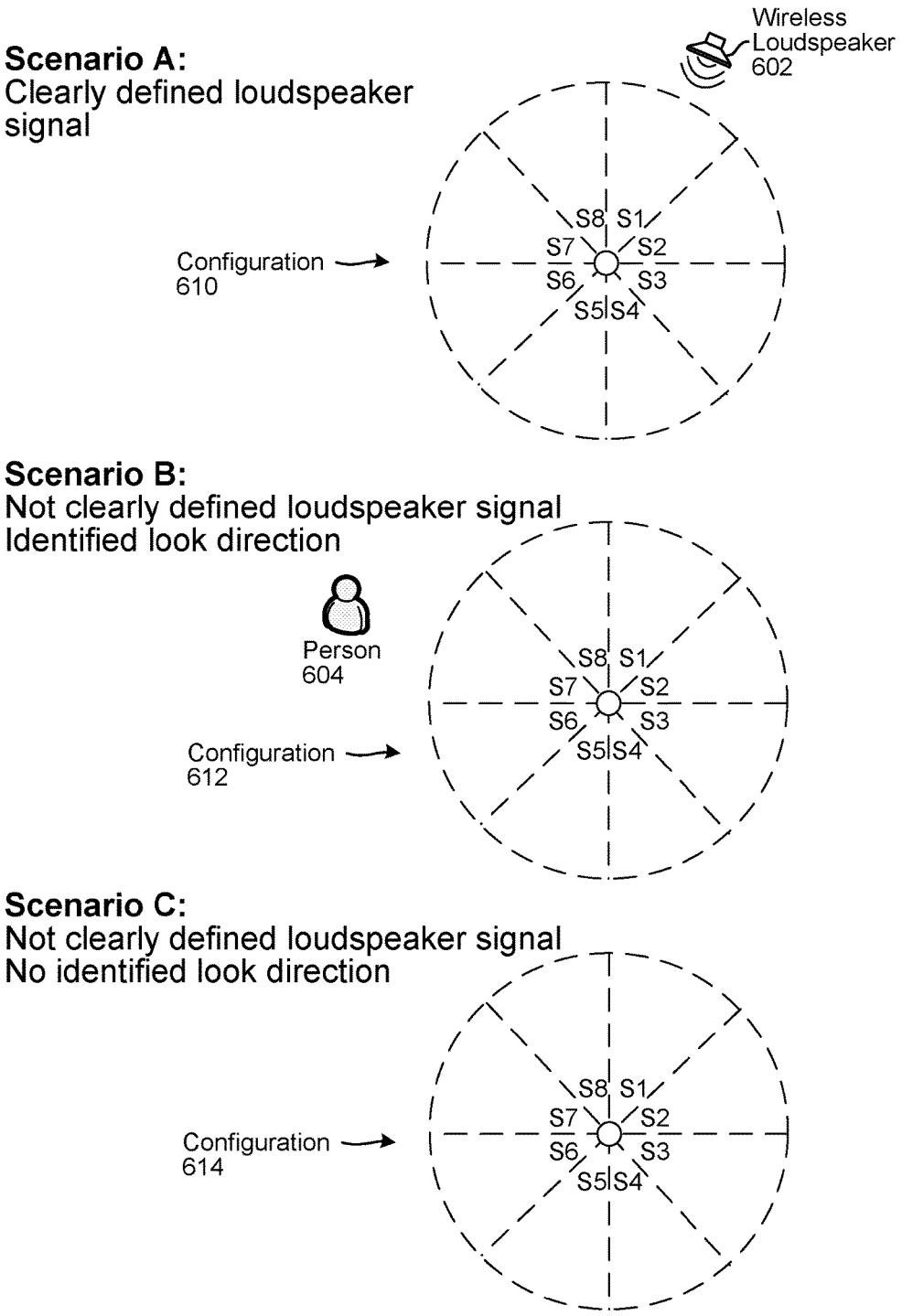
FIG. 6 illustrates an example of different techniques of adaptive beamforming according to embodiments of the present disclosure.

FIG. 6 illustrates an example of different techniques of adaptive beamforming according to embodiments of the present disclosure. As illustrated in FIG. 6, a first technique may be used with scenario A, which may occur when the device 102 detects a clearly defined loudspeaker signal. For example, the configuration 610 includes a wireless loudspeaker 602 and the device 102 may associate the wireless loudspeaker 602 with a first section S1. The device 102 may identify the wireless loudspeaker 602 and/or associate the first section S1 with a wireless loudspeaker. As will be discussed in greater detail below, the device 102 may set the first section S1 as a reference signal and may identify one or more sections as a target signal. While the configuration 610 includes a single wireless loudspeaker 602, the disclosure is not limited thereto and there may be multiple wireless loudspeakers 602.

As illustrated in FIG. 6, a second technique may be used with scenario B, which occurs when the device 102 doesn't detect a clearly defined loudspeaker signal but does identify a speech position (e.g., near end talk position) associated with person 604. For example, the device 102 may identify the person 604 and/or a position associated with the person 604 using audio data (e.g., audio beamforming), video data (e.g., facial recognition) and/or other inputs known to one of skill in the art. As illustrated in FIG. 6, the device 102 may associate the person 604 with section S7. By determining the position associated with the person 604, the device 102 may set the section (e.g., S7) as a target signal and may set one or more sections as reference signals.

As illustrated in FIG. 6, a third technique may be used with scenario C, which occurs when the device 102 doesn't detect a clearly defined loudspeaker signal or a speech position. For example, audio from a wireless loudspeaker may reflect off of multiple objects such that the device 102 receives the audio from multiple locations at a time and is therefore unable to locate a specific section to associate with the wireless loudspeaker. Due to the lack of a defined loudspeaker signal and a speech position, the device 102 may cancel an acoustic echo by creating pairwise combinations of the sections. For example, as will be described in greater detail below, the device 102 may use a first section S1 as a target signal and a fifth section S5 as a reference signal in a first equation and may use the fifth section S5 as a target signal and the first section S1 as a reference signal in a second equation. The device 102 may combine each of the different sections such that there are the same number of equations (e.g., eight) as sections (e.g., eight).

Figure 7:
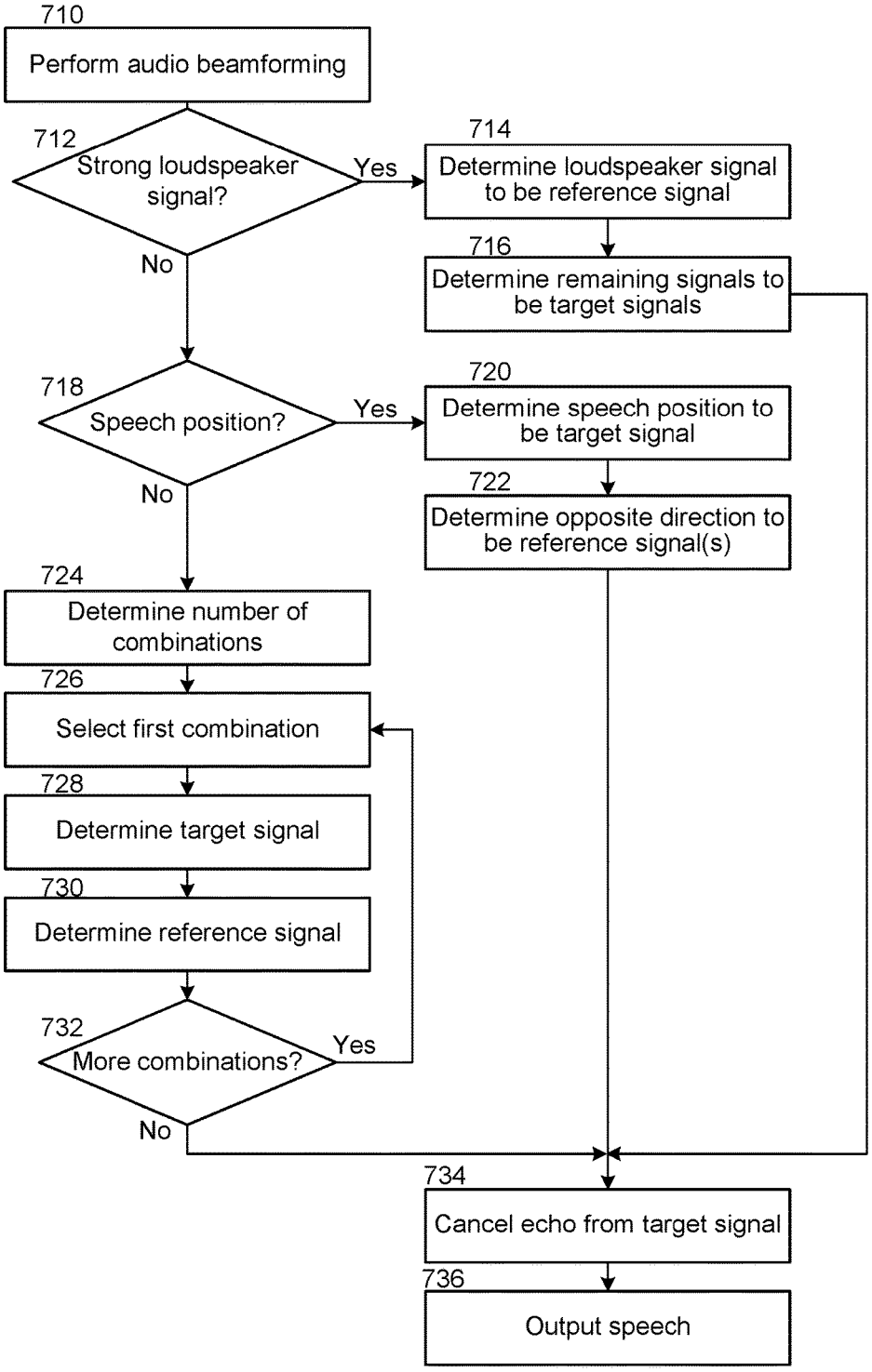
FIG. 7 is a flowchart conceptually illustrating an example method for performing adaptive beamforming according to embodiments of the present disclosure.

FIG. 7 is a flowchart conceptually illustrating an example method for performing adaptive beamforming according to embodiments of the present disclosure. As illustrated in FIG. 7, the device 102 may perform (710) audio beamforming to separate audio data into multiple sections. The device 102 may determine (712) if there is a strong loudspeaker signal in one or more of the sections. If there is a strong loudspeaker signal, the device 102 may determine (714) the loudspeaker signal (e.g., section associated with the loudspeaker signal) to be a reference signal and may determine (716) remaining signals to be target signals. The device 102 may then cancel (734) an echo from the target signal using the reference signal and may output (736) speech, as discussed above with regard to FIG. 1B.

While not illustrated in FIG. 7, if the device 102 detects two or more strong loudspeaker signals, the device 102 may determine one or more reference signals corresponding to the two or more strong loudspeaker signals and may determine one or more target signals corresponding to the remaining portions of the audio beamforming, As discussed above, the device 102 may determine any combination of target signals, reference signals and output signals without departing from the disclosure. For example, as discussed above with regard to FIG. 6B, the device 102 may determine reference signals associated with the wireless loudspeakers and may select remaining portions of the beamforming output as target signals. Additionally or alternatively, as illustrated in FIG. 6C, if the device 102 detects multiple wireless loudspeakers then the device 102 may generate separate reference signals, with each wireless loudspeaker associated with a reference signal and sections opposite the reference signals associated with corresponding target signals. For example, the device 102 may detect a first wireless loudspeaker, determine a corresponding section to be a first reference signal, determine one or more sections opposite the first reference signal and determine the one or more sections to be first target signals. Then the device 102 may detect a second wireless loudspeaker, determine a corresponding section to be a second reference signal, determine one or more sections opposite the second reference signal and determine the one or more sections to be second target signals.

If the device 102 does not detect a strong loudspeaker signal, the device 102 may determine (718) if there is a speech position in the audio data or associated with the audio data. For example, the device 102 may identify a person speaking and/or a position associated with the person using audio data (e.g., audio beamforming), associated video data (e.g., facial recognition) and/or other inputs known to one of skill in the art. In some examples, the device 102 may determine that speech is associated with a section and may determine a speech position using the section. In other examples, the device 102 may receive video data associated with the audio data and may use facial recognition or other techniques to determine a position associated with a face recognized in the video data. If the device 102 detects a speech position, the device 102 may determine (720) the speech position to be a target signal and may determine (722) an opposite direction to be reference signal(s). For example, a first section S1 may be associated with the target signal and the device 102 may determine that a fifth section S5 is opposite the first section S1 and may use the fifth section S5 as the reference signal. The device 102 may determine more than one section to be reference signals without departing from the disclosure. The device 102 may then cancel (734) an echo from the target signal using the reference signal(s) and may output (736) speech, as discussed above with regard to FIG. 1B. While not illustrated in FIG. 7, the device 102 may determine two or more speech positions (e.g., near end talk positions) and may determine one or more target signals based on the two or more speech positions. For example, the device 102 may select multiple sections of the audio beamforming corresponding to the two or more speech positions as a single target signal, or the device 102 may select first sections of the audio beamforming corresponding to a first speech position as a first target signal and may select second sections of the audio beamforming corresponding to a second speech position as a second target signal.

If the device 102 does not detect a speech position, the device 102 may determine (724) a number of combinations based on the audio beamforming. For example, the device 102 may determine a number of combinations of opposing sections and/or microphones, as illustrated in FIGS. 8A-8B. The device 102 may select (726) a first combination, determine (728) a target signal and determine (730) a reference signal. For example, the device 102 may select a first section S1 as a target signal and select a fifth section S5, opposite the first section S1, as a reference signal. The device 102 may determine (732) if there are additional combinations and if so, may loop to step 726 and repeat steps 726-730. For example, in a later combination the device 102 may select the fifth section S5 as a target signal and the first section S1 as a reference signal. Once the device 102 has determined a target signal and a reference signal for each combination, the device 102 may cancel (734) an echo from the target signals using the reference signals and output (736) speech.

As shown in FIG. 1B, audio data 120 captured by a microphone array may be input into an analysis filterbank 152. The filterbank 152 may include a uniform discrete Fourier transform (DFT) filterbank which converts audio data 120 in the time domain into an audio signal Y 154 in the sub-band domain. The audio signal Y 154 may incorporate audio signals corresponding to multiple different microphones as well as different sub-bands (i.e., frequency ranges) as well as different frame indices (i.e., time ranges). Thus the audio signal from the mth microphone may be represented as $X_m(k,n)$, where k denotes the sub-band index and n denotes the frame index. The combination of all audio signals for all microphones for a particular sub-band index frame index may be represented as X(k,n).

The audio signal Y 154 may be passed to the FBF 160 including the filter and sum component 162. For ease of illustration, the filter and sum component 162 may also be referred to as a beamformer 162 or beamformer block 162 without departing from the disclosure. The FBF 160 may be implemented as a robust super-directive beamformer (SDBF), delay and sum beamformer (DSB), differential beamformer, or the like. The FBF 160 is presently illustrated as a super-directive beamformer (SDBF) due to its improved directivity properties. The filter and sum component 162 takes the audio signals from each of the microphones and boosts the audio signal from the microphone associated with the desired look direction and attenuates signals arriving from other microphones/directions. The filter and sum component 162 may operate as illustrated in FIG. 8.

Figure 8:
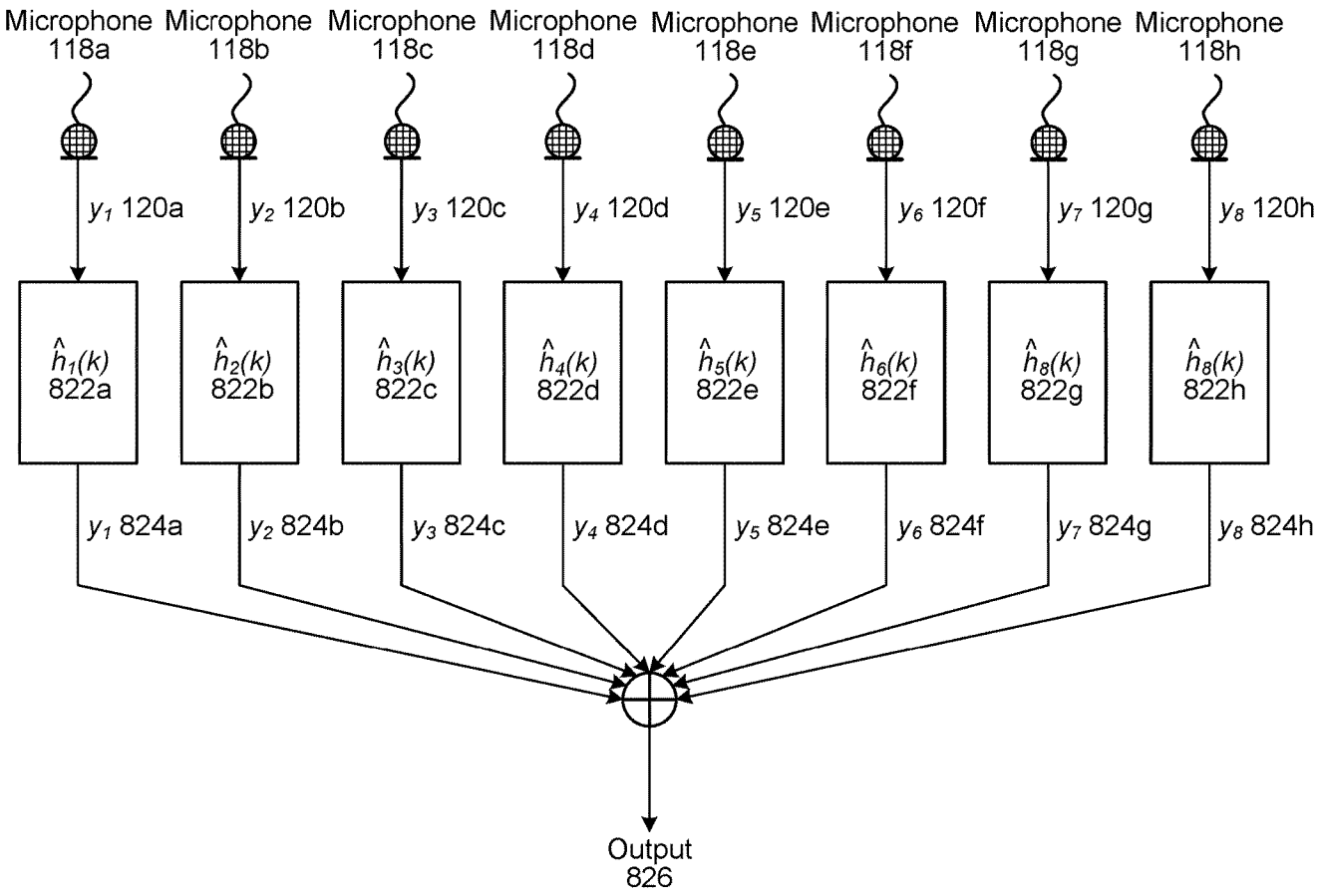
FIG. 8 illustrates an example of a filter and sum component according to embodiments of the present disclosure

As shown in FIG. 8, the filter and sum component 162 may be configured to match the number of microphones 118 of the microphone array. For example, for a microphone array with eight microphones 118, the filter and sum component 162 may have eight filter blocks 822. The audio signals $x_1$ 120*a* through $x_8$ 120*h* for each microphone 118 are received by the filter and sum component 162. The audio signals $x_1$ 120*a* through $x_8$ 120*h* correspond to individual microphones 118*a* through 118*h*, for example audio signal $x_1$ 120*a* corresponds to microphone 118*a*, audio signal $x_2$ 120*b* corresponds to microphone 118*b* and so forth. Although shown as originating at the microphones 118, the audio signals $x_1$ 120*a* through $x_8$ 120*h* may be in the sub-band domain and thus may actually be output by the analysis filterbank 152 before arriving at the filter and sum component 162. Each filter block 822 is associated with a particular microphone 118 (e.g., filter block 822*a* corresponds to first microphone 118*a*, second filter block 822*b* corresponds to second microphone 118*b*, etc.) and is configured to either boost (e.g., increase) or dampen (e.g., decrease) its respective incoming audio signal by the respective beamformer filter coefficient h depending on the configuration of the FBF 160. Each resulting filtered audio signal y 824 will be the audio signal y 120 weighted by the beamformer filter coefficient h of the filter block 822. For example, $\hat{y}_1=y_1*h_1$, $\hat{y}_2=y_2*h_2$, and so forth. The beamformer filter coefficients h are configured for a particular FBF 160 associated with a particular beam.

Figure 9:
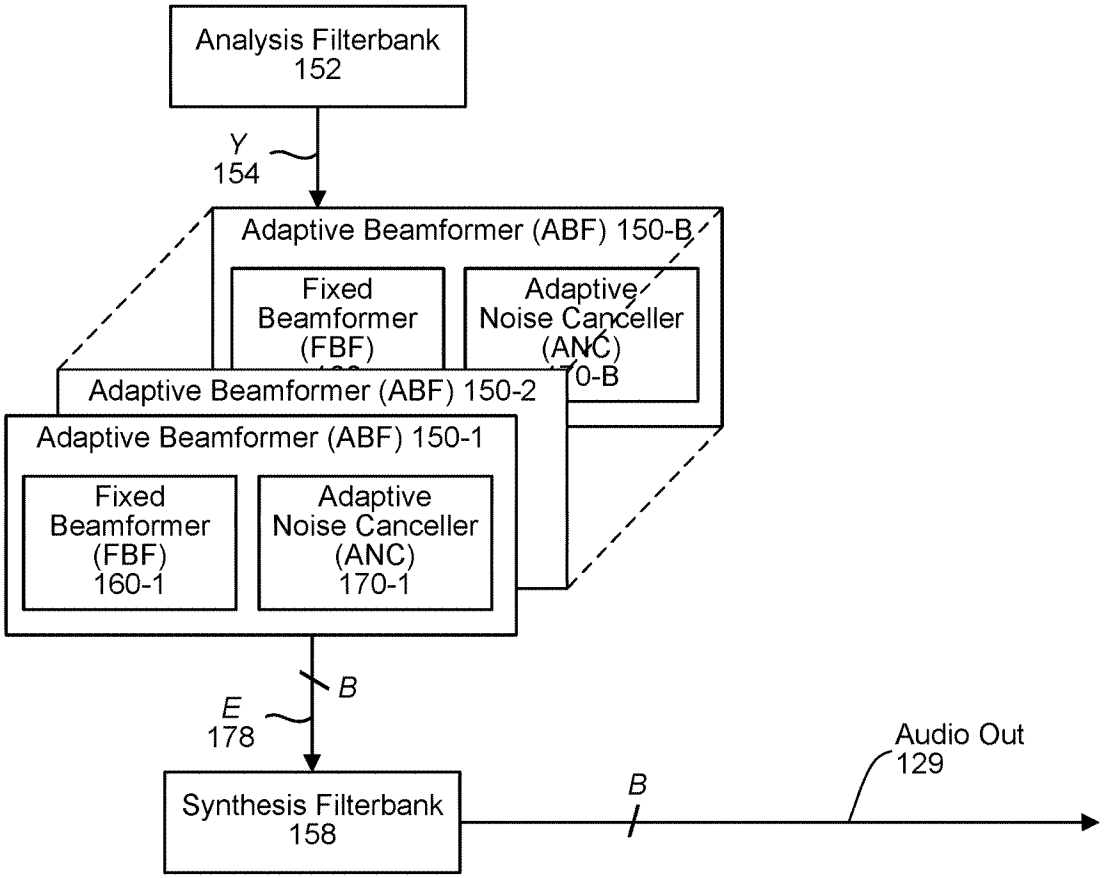
FIG. 9 illustrates a configuration having an adaptive beamformer for each beam according to embodiments of the present disclosure.

As illustrated in FIG. 9, the adaptive beamformer (ABF) 150 configuration (including the FBF 160 and the ANC 170) illustrated in FIG. 1B, may be implemented multiple times in a single system 100. The number of adaptive beamformer 150 blocks may correspond to the number of beams B. For example, if there are eight beams, there may be eight FBF components 160 and eight ANC components 170. Each adaptive beamformer 150 may operate as described in reference to FIG. 1B, with an individual output e (e.g., error signal 178) for each beam created by the respective adaptive beamformer 150. Thus, B different error signals 178 may result. For system configuration purposes, there may also be B different other components, such as the synthesis filterbank 158, but that may depend on system configuration. Each individual beam pipeline may result in its own audio output 129, such that there may be B different audio outputs 129. A downstream component, for example a speech recognition component, may receive all the different audio outputs 129 and may use some processing to determine which beam (or beams) correspond to the most desirable audio output data (for example a beam with a highest SNR output audio data or the like).

Each particular FBF 160 may be tuned with filter coefficients to boost audio from one of the particular beams. For example, FBF 160-1 may be tuned to boost audio from beam 1, FBF 160-2 may be tuned to boost audio from beam 2 and so forth. If the filter block is associated with the particular beam, its beamformer filter coefficient h will be high whereas if the filter block is associated with a different beam, its beamformer filter coefficient h will be lower. For example, for FBF 160-7 direction 7, the beamformer filter coefficient $h_7$ for filter block 822*g* may be high while beamformer filter coefficients $h_1$-$h_6$ and $h_8$ may be lower. Thus the filtered audio signal $y_7$ will be comparatively stronger than the filtered audio signals $y_1$-$y_6$ and $y_8$ thus boosting audio from direction 7 relative to the other directions. The filtered audio signals will then be summed together to create the amplified first audio signal Y' 164. Thus, the FBF 160 may phase align microphone data toward a given direction and add it up. Signals that are arriving from a particular direction (e.g., look direction) are reinforced, but signals that are not arriving from the look direction are suppressed. The robust FBF coefficients are designed by solving a constrained convex optimization problem and by specifically taking into account the gain and phase mismatch on the microphones. The filter coefficients will be used for all audio signals Y 154 until if/when they are reprogrammed. Thus, in contrast to the adaptive filter coefficients used in the noise estimation filters 174 and/or echo estimation filters 124, the filter coefficients used in the filter blocks 822 are static.

The individual beamformer filter coefficients may be represented as $H_{BF,m}(r)$, where r=0, . . . R, where R denotes the number of beamformer filter coefficients in the subband domain. Thus, the amplified first audio signal Y' 164 output by the filter and sum component 162 may be represented as the summation of each microphone signal filtered by its beamformer coefficient and summed up across the M microphones:

$$Y(k, n) = \sum_{m=1}^{M} \sum_{r=0}^{R} H_{BF,m}(r) X_m(k, n-r) \quad [8]$$

Turning once again to FIG. 1B, the amplified first audio signal Y' 164, expressed in Equation 8, may be fed into a delay component 166, which delays the forwarding of the output Y until further adaptive noise cancelling functions as described below may be performed. One drawback to the amplified first audio signal Y' 164, however, is that it may include residual directional noise that was not canceled by the FBF 160. To cancel that directional noise, the system 100 may operate an adaptive noise canceller (ANC) 170 which includes components to obtain the remaining noise reference signal which may be used to cancel the remaining noise from the amplified first audio signal Y' 164.

As shown in FIG. 1B, the ANC 170 may include a number of nullformer blocks 172*a* through 172*p*. The system 100 may include P number of nullformer blocks 172 where P corresponds to the number of channels, where each channel corresponds to a direction in which the system may focus the nullformer blocks 172 to isolate detected noise. The number of channels P is configurable and may be predetermined for a particular system 100. Each nullformer block 172 is configured to operate similarly to the beamformer block 162, only instead of the beamformer filter coefficients h for the nullformer blocks being selected to boost the look direction, they are selected to boost one of the other, non-look directions. Thus, for example, nullformer 172*a* is configured to boost audio from direction 1, nullformer 172*b* is configured to boost audio from direction 2, and so forth. Thus, the nullformer may actually dampen the desired audio (e.g., speech) while boosting and isolating undesired audio (e.g., noise). For example, nullformer 172*a* may be configured (e.g., using a high beamformer filter coefficient $h_1$ for filter block 822*a*) to boost the signal from microphone 118*a*/direction 1, regardless of the look direction. Nullformers 172*b* through 172*p* may operate in similar fashion relative to their respective microphones/directions, though the individual coefficients for a particular channel's nullformer in one beam pipeline may differ from the individual coefficients from a nullformer for the same channel in a different beam's pipeline. The output Z 173 of each nullformer block 172 will be a boosted signal corresponding to a non-desired direction.

In some examples, each particular filter and sum component 172 may be tuned with beamformer filter coefficients h to boost audio from one or more directions, with the beamformer filter coefficients h fixed until the filter and sum component 172 is reprogrammed. For example, a first filter and sum component 172*a* may be tuned to boost audio from a first direction, a second filter and sum component 172*b* may be tuned to boost audio from a second direction, and so forth. If a filter block 822 is associated with the particular direction (e.g., first filter block 822*a* in the first filter and sum component 172*a* that is associated with the first direction), its beamformer filter coefficient h will be high whereas if the filter block 822 is associated with a different direction, its beamformer filter coefficient h will be lower.

To illustrate an example, for filter and sum component 172*c* direction 3, the beamformer filter coefficient $h_3$ for the third filter block 822*c* may be high while beamformer filter coefficients $h_1$-$h_6$ and $h_8$ may be lower. Thus the filtered audio signal $y_3$ will be comparatively stronger than the filtered audio signals $y_1$-$y_2$ and $y_4$-$y_8$ thus boosting audio from direction 3 relative to the other directions. The filtered audio signals will then be summed together to create the third output Z 173*c*. Thus, the filter and sum components 172 may phase align microphone data toward a given direction and add it up. Signals that are arriving from a particular direction are reinforced, but signals that are not arriving from the particular direction are suppressed. The robust beamformer filter coefficients h are designed by solving a constrained convex optimization problem and by specifically taking into account the gain and phase mismatch on the microphones 118. The beamformer filter coefficients h will be used for all audio signals Y 154 until if/when they are reprogrammed. Thus, in contrast to the adaptive filter coefficients used in the noise estimation filters 174 and/or echo estimation filters 124, the beamformer filter coefficients h used in the filter blocks 822 are static.

While FIG. 8 was previously described with reference to the filter and sum component 162, the components illustrated in FIG. 8 may also illustrate an operation associated with individual filter and sum components 172. Thus, a filter and sum component 172 may be configured to match the number of microphones 118 of the microphone array. For example, for a microphone array with eight microphones 118, the filter and sum component 172 may have eight filter blocks 822. The audio signals $x_1$ 120*a* through $x_8$ 120*h* for each microphone 118 are received by the filter and sum component 172. The audio signals $x_1$ 120*a* through $x_8$ 120*h* correspond to individual microphones 118*a* through 118*h*, for example audio signal $x_1$ 120*a* corresponds to microphone 118*a*, audio signal $x_2$ 120*b* corresponds to microphone 118*b* and so forth. Although shown as originating at the microphones 118, the audio signals $x_1$ 120*a* through $x_8$ 120*h* may be in the sub-band domain and thus may actually be output by the analysis filterbank 152 before arriving at the filter and sum component 172. Each filter block 822 is associated with a particular microphone 118 (e.g., filter block 822*a* corresponds to first microphone 118*a*, second filter block 822*b* corresponds to second microphone 118*b*, etc.) and is configured to either boost (e.g., increase) or dampen (e.g., decrease) its respective incoming audio signal by the respective beamformer filter coefficient h depending on the configuration of the filter and sum component 172. Each resulting filtered audio signal y 824 will be the audio signal y 120 weighted by the beamformer filter coefficient h of the filter block 822. For example, $\hat{y}_1=y_1*h_1$, $\hat{y}_2=y_2*h_2$, and so forth. The beamformer filter coefficients h are configured for a particular filter and sum component 172 associated with a particular beam.

Thus, each of the beamformer 162/nullformers 172 receive the audio signals Y 154 from the analysis filterbank 152 and generate an output using the filter blocks 822. While each of the beamformer 162/nullformers 172 receive the same input (e.g., audio signals Y 154), the outputs vary based on the respective beamformer filter coefficient h used in the filter blocks 822. For example, a beamformer 162, a first nullformer 172*a* and a second nullformer 172*b* may receive the same input, but an output of the beamformer 162 (e.g., amplified first audio signal Y' 164) may be completely different than outputs of the nullformers 172*a*/172*b*. In addition, a first output from the first nullformer 172*a* (e.g., first noise reference signal 173*a*) may be very different from a second output from the second nullformer 172*b* (e.g., second noise reference signal 173*b*). The beamformer filter coefficient h used in the filter blocks 822 may be fixed for each of the beamformer 162/nullformers 172. For example, the beamformer filter coefficients h used in the filter blocks 822 may be designed by solving a constrained convex optimization problem and by specifically taking into account the gain and phase mismatch on the microphones. The beamformer filter coefficients h will be used for all audio signals Y 154 until if/when they are reprogrammed. Thus, in contrast to the adaptive filter coefficients used in the noise estimation filters 174 and/or echo estimation filters 124, the beamformer filter coefficients h used in the filter blocks 822 are static.

As audio from non-desired direction may include noise, each signal Z 173 may be referred to as a noise reference signal. Thus, for each channel 1 through P the ANC 170 calculates a noise reference signal Z 173, namely $Z_1$ 173*a* through $Z_P$ 173*p*. Thus, the noise reference signals that are acquired by spatially focusing towards the various noise sources in the environment and away from the desired look-direction. The noise reference signal for channel p may thus be represented as $Z_p(k,n)$ where $Z_P$ is calculated as follows:

$$Z_p(k,n)=\sum_{m=1}^{M}\sum_{r=0}^{R}H_{NF,m}(p,r)X_m(k,n-r) \quad [9]$$

where $H_{NF,m}(p,r)$ represents the nullformer coefficients for reference channel p.

As described above, the coefficients for the nullformer filter blocks 822 are designed to form a spatial null toward the look direction while focusing on other directions, such as directions of dominant noise sources. The output Z 173 (e.g., $Z_1$ 173*a* through $Z_P$ 173*p*) from the individual nullformer blocks 172 thus represent the noise from channels 1 through P.

The individual noise reference signals may then be filtered by noise estimation filter blocks 174 configured with weights W to adjust how much each individual channel's noise reference signal should be weighted in the eventual combined noise reference signal $\hat{Y}$ 176. The noise estimation filters (further discussed below) are selected to isolate the noise to be cancelled from the amplified first audio signal Y' 164. The individual channel's weighted noise reference signal $\hat{y}$ 175 is thus the channel's noise reference signal Z multiplied by the channel's weight W. For example, $\hat{y}_1=Z_1*W_1$, $\hat{y}_2=Z_2*W_2$, and so forth. Thus, the combined weighted noise estimate $\hat{Y}$ 176 may be represented as:

$$\hat{Y}_P(k,n)=\sum_{l=0}^{L}W_P(k,n,l)Z_P(k,n-l) \quad [10]$$

where $W_p(k,n,l)$ is the l th element of $W_p(k,n)$ and l denotes the index for the filter coefficient in subband domain. The noise estimates of the P reference channels are then added to obtain the overall noise estimate:

$$\hat{Y}(k,n)=\sum_{p=1}^{P}\hat{Y}_p(k,n) \quad [11]$$

The combined weighted noise reference signal $\hat{Y}$ 176, which represents the estimated noise in the audio signal, may then be subtracted from the amplified first audio signal Y' 164 to obtain an error signal e 178 (e.g., output audio data), which represents the error between the combined weighted noise reference signal $\hat{Y}$ 176 and the amplified first audio signal Y' 164. The error signal e 178 is thus the estimated desired non-noise portion (e.g., target signal portion) of the audio signal and may be the output of the adaptive beamformer 150. The error signal e 178, may be represented as:

$$E(k,n)=Y(k,n)-\hat{Y}(k,n) \quad [12]$$

As shown in FIG. 1B, the error signal 178 may also be used to update the weights W of the noise estimation filter blocks 174 using sub-band adaptive filters, such as with a normalized least mean square (NLMS) approach:

$$W_p(k,n) = W_p(k,n-1) + \frac{\mu_p(k,n)}{\|Z_p(k,n)\|^2 + \varepsilon} Z_p(k,n)E(k,n) \quad [13]$$

where $Z_p(k,n)=[Z_p(k,n)\ Z_p(k,n-1)\ \ldots\ Z_p(k,n-L)]^T$ is the noise estimation vector for the pth channel, $\mu_p(k,n)$ is the adaptation step-size for the pth channel, and ε is a regularization factor to avoid indeterministic division. The weights may correspond to how much noise is coming from a particular direction.

As can be seen in Equation 13, the updating of the weights W involves feedback. The weights W are recursively updated by the weight correction term (the second half of the right hand side of Equation 12) which depends on the adaptation step size, $\mu_p(k,n)$, which is a weighting factor adjustment to be added to the previous weighting factor for the filter to obtain the next weighting factor for the filter (to be applied to the next incoming signal). To ensure that the weights are updated robustly (to avoid, for example, target signal cancellation) the step size $\mu_p(k,n)$ may be modulated according to signal conditions. For example, when the desired signal arrives from the look direction, the step-size is significantly reduced, thereby slowing down the adaptation process and avoiding unnecessary changes of the weights W. Likewise, when there is no signal activity in the look direction, the step-size may be increased to achieve a larger value so that weight adaptation continues normally. The step-size may be greater than 0, and may be limited to a maximum value. Thus, the system may be configured to determine when there is an active source (e.g., a speaking user) in the look-direction. The system may perform this determination with a frequency that depends on the adaptation step size.

The step-size controller 190 will modulate the rate of adaptation. Although not shown in FIG. 1B, the step-size controller 190 may receive various inputs to control the step size and rate of adaptation including the noise reference signals 173, the amplified first audio signal Y' 164, the previous step size, the nominal step size (described below) and other data. The step-size controller may compute the adaptation step-size for each channel p, sub-band k, and frame n. To make the measurement of whether there is an active source in the look-direction, the system may measure a ratio of the energy content of the beam in the look direction (e.g., the look direction signal in amplified first audio signal Y' 164) to the ratio of the energy content of the beams in the non-look directions (e.g., the non-look direction signals of noise reference signals $Z_1$ 173*a* through $Z_P$ 173*p*). This may be referred to as a beam-to-null ratio (BNR). For each subband, the system may measure the BNR. If the BNR is large, then an active source may be found in the look direction, if not, an active source may not be in the look direction.

At a first time period, audio signals from the microphone array 118 may be processed as described above using a first set of weights for the noise estimation filter blocks 174. Then, the error signal e 178 associated with that first time period may be used to calculate a new set of weights for the noise estimation filter blocks 174. The new set of weights may then be used to process audio signals from a microphone array 118 associated with a second time period that occurs after the first time period. Thus, for example, a first filter weight may be applied to a noise reference signal associated with a first audio signal for a first microphone/first direction from the first time period. A new first filter weight may then be calculated and the new first filter weight may then be applied to a noise reference signal associated with the first audio signal for the first microphone/first direction from the second time period. The same process may be applied to other filter weights and other audio signals from other microphones/directions.

The estimated non-noise (e.g., output) error signal e 178 may be processed by a synthesis filterbank 156 which converts the error signal 178 into time-domain audio output 129 which may be sent to a downstream component (such as a speech processing system) for further operations.

Figure 1C:
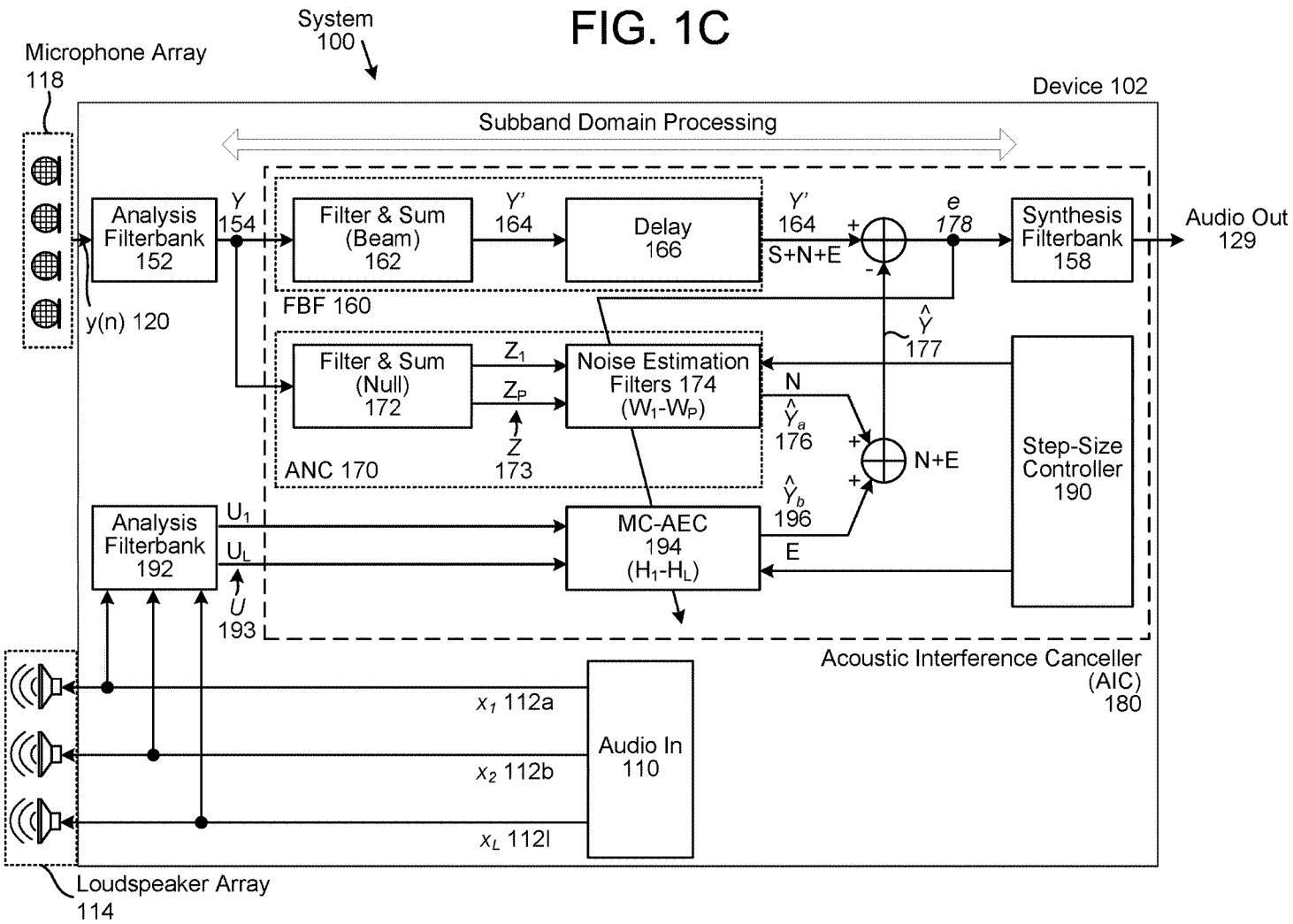

While FIG. 1A illustrates a conventional MC-AEC (e.g., MC-AEC 108*a*) and FIG. 1B illustrates an adaptive beamformer 150, FIG. 1C illustrates an example of combining the benefits of the conventional AEC circuit and the adaptive beamformer 150 to improve a performance of the device 102. For example, the conventional AEC system (e.g., MC-AEC 108*a*) provides good performance when the system is linear (e.g., no distortion, fixed delay and/or low frequency offset between the reference signals 112 and the echo signals 120 input to the microphones 118), whereas the adaptive beamformer 150 outperforms the conventional AEC system when the system is nonlinear (e.g., there is distortion, variable delay and/or high frequency offset between the reference signals 112 and the echo signals 120 input to the microphones 118).

To determine whether the system is linear, the device 102 may compare the reference signals 112 to the echo signals 120 and determine an amount and/or variation over time of distortion, propagation delay, drift (e.g., clock drift), skew and/or frequency offset between the reference signals 112 and the echo signals 120. For example, the device 102 may determine a first propagation delay at a first time and a second propagation delay at a second time and determine that the there is a variable delay if the first propagation delay is not similar to the second propagation delay. A variable delay is associated with a nonlinear system, as is an amount of distortion, drift, skew and/or frequency offset above a threshold or variations in the distortion, drift, skew and/or frequency offset. Additionally or alternatively, the device 102 may determine that the system is linear based on how the device 102 sends the reference signal 112 to the loudspeaker 114. For example, the system is nonlinear when the device 102 sends the reference signal 112 to the loudspeaker 114 wirelessly but may be linear when the device 102 sends the reference signal 112 to the loudspeaker 114 using a wired line out output. The device 102 may also determine that the system is linear based on configurations of the system, such as if the device 102 knows the entire system or models a specific loudspeaker. In contrast, if the device 102 outputs the reference signal 112 to an amplifier or unknown loudspeaker, the device 102 may determine that the system is nonlinear as the device 102 cannot model how the amplifier or unknown loudspeaker modifies the reference signal 112.

FIG. 1C illustrates a high-level conceptual block diagram of interference cancellation aspects of an Acoustic Interference Cancellation (AIC) system 100 using an adaptive noise canceller (ANC) and a multi-channel AEC. The AIC system 100 may cancel both an acoustic echo and acoustic noise (e.g., ambient acoustic noise), which may collectively be referred to as "acoustic interference" or just "interference." The AIC system 100 illustrated in FIG. 1C improves upon the MC-AEC illustrated in FIG. 1A and the adaptive noise canceller illustrated in FIG. 1B by combining both components. For example, an acoustic interference canceller (AIC) 180 illustrated in FIG. 1C includes first components associated with the adaptive beamformer 150 (e.g., filter and sum component 162 associated with the look direction or "beam"

and the delay component 166, which are included in the FBF 160) to generate a target signal (e.g., amplified first audio signal Y' 164), second components associated with the adaptive beamformer 150 (e.g., filter and sum components 172 that form a spatial null in the look direction and noise estimation filter blocks 174, which are included in the ANC 170) to generate an estimate of acoustic noise, as well as MC-AEC 194 to generate an estimate of acoustic echo. Thus, instead of cancelling only the acoustic echo (e.g., FIG. 1A) or the acoustic noise (e.g., FIG. 1B), the AIC 180 illustrated in FIG. 1C combines the estimate of the acoustic echo and the estimate of the acoustic noise and cancels both from the target signal. As several components illustrated in FIG. 1C are illustrated in FIGS. 1A-1B, a corresponding description is omitted.

For ease of explanation, the disclosure may refer to removing an estimated echo signal from a target signal to perform acoustic echo cancellation and/or removing an estimated interference signal from a target signal to perform acoustic interference cancellation. The system 100 removes the estimated echo/interference signal by subtracting the estimated echo/interference signal from the target signal, thus cancelling the estimated echo/interference signal. This cancellation may be referred to as "removing," "subtracting" or "cancelling" interchangeably without departing from the disclosure. Additionally or alternatively, in some examples the disclosure may refer to removing an acoustic echo, ambient acoustic noise and/or acoustic interference. As the acoustic echo, the ambient acoustic noise and/or the acoustic interference are included in the input audio data and the system 100 does not receive discrete audio signals corresponding to these portions of the input audio data, removing the acoustic echo/noise/interference corresponds to estimating the acoustic echo/noise/interference and cancelling the estimate from the target signal.

As illustrated in FIG. 1C, a microphone array 118 may capture audio and generate audio data (e.g., echo signals y(n) 120) and the analysis filterbank 152 may convert the echo signals y(n) 120 into audio signals Y 154. For example, the analysis filterbank 152 may convert the echo signals y(n) 120 from the time domain into the frequency/sub-band domain, where $x_m$ denotes the time-domain microphone data for the mth microphone, m=1, . . . , M. The filterbank 152 divides the resulting audio signals into multiple adjacent frequency bands, resulting in the audio signals Y 154.

The system 100 then operates a fixed beamformer (FBF) to amplify a first audio signal from a desired direction to obtain an amplified first audio signal Y' 164. For example, the audio signal Y 154 may be fed into a fixed beamformer (FBF) component 160, which may include a filter and sum component 162 associated with the "beam" (e.g., look direction). The FBF 160 may be a separate component or may be included in another component such as a general adaptive beamformer 150. As explained above with regard to FIG. 8, the FBF 160 may operate a filter and sum component 162 to isolate the first audio signal from the direction of an audio source and generate the amplified first audio signal Y' 164. The delay component 166 may delay the amplified first audio signal Y' 164 in order to make sure that the system 100 is causal. For example, the delay component 166 may be configured to delay the amplified first audio signal Y' 164 such that the reference signal (e.g., interference reference signal $\hat{Y}$ 177) is leading the amplified first audio signal Y' 164.

The system 100 may also operate an adaptive noise canceller (ANC) 170 to amplify audio signals from directions other than the direction of an audio source (e.g., non-look directions). Those audio signals represent noise signals so the resulting amplified audio signals from the ANC 170 may be referred to as noise reference signals Z 173 (e.g., $Z_1$-$Z_P$). The ANC 170 may include filter and sum components 172 configured to form a spatial null toward the look direction while focusing on other directions to generate "null" signals (e.g., noise reference signals Z 173). The ANC 170 may include P filter and sum components 172, with each filter and sum component 172 corresponding to a unique noise reference signal Z 173. The number of unique noise reference signals Z 173 may vary depending on the system 100 and/or the audio signal Y 154. In some examples, ANC 170 may generate two or three unique noise reference signal Z 173 (e.g., $Z_1$ 173*a*, $Z_2$ 173*b* and $Z_3$ 173*c*), although the disclosure is not limited thereto.

The system 100 may then weight the noise reference signals Z 173, for example using adaptive filters (e.g., noise estimation filter blocks 174) discussed in greater detail above and below with regard to FIG. 10A. As illustrated in FIG. 1C, the noise estimation filter blocks 174 may be included in an adaptive noise canceller (ANC) and may have weights W (e.g., $W_1$-$W_P$). The system may combine the weighted noise reference signals 175 (e.g., $\hat{y}_1$-$\hat{y}_P$) into a combined (weighted) noise reference signal $\hat{Y}_a$ 176. Alternatively the system may not weight the noise reference signals Z 173 and may simply combine them into the combined noise reference signal $\hat{Y}_a$ 176 without weighting.

The system 100 may also include an analysis filterbank 192 that may receive the reference signals x(n) 112 (e.g., 112*a*-112*l*) that are sent to the loudspeaker array 114. The analysis filterbank 192 may convert the reference signals x(n) 112 into audio reference signals U 193. For example, the analysis filterbank 192 may convert the reference signals x(n) 112 from the time domain into the frequency/sub-band domain, where $x_l$ denotes the time-domain reference audio data for the lth loudspeaker, l=1, . . . , L. The filterbank 192 divides the resulting audio signals into multiple adjacent frequency bands, resulting in the audio reference signals U 193. While FIG. 1C illustrates the analysis filterbank 192 receiving the reference signals 112, the disclosure is not limited thereto and the analysis filterbank 192 may receive modified reference signals 123 from playback reference logic 103 without departing from the disclosure. Additionally or alternatively, the analysis filterbank 192 may include the playback reference logic 103 without departing from the disclosure.

As illustrated in FIG. 1C, the number of audio reference signals U 193 corresponds to the number of channels (e.g., number of unique audio signals or "playback signals") sent to the loudspeaker array 114. In some examples, the number of channels corresponds to the number of loudspeakers in the loudspeaker array 114. For example, a loudspeaker array 114 includes two loudspeakers 114 (e.g., stereo) may correspond to two channels, whereas a loudspeaker array 114 including six loudspeakers 114 (e.g., 5.1 surround sound) may correspond to six channels. However, the disclosure is not limited thereto and there may be upmixing or downmixing performed within the loudspeaker array 114. Thus, the number of channels may be different than the number of loudspeakers without departing from the disclosure.

The audio reference signals U 193 may be used by a multi-channel acoustic echo canceller (MC-AEC) 194 to generate a combined (weighted) echo reference signal $\hat{Y}_b$ 196. For example, the system MC-AEC 194 may weight the audio reference signals U 193, for example using adaptive filters (e.g., transfer functions H(n) illustrated in FIG. 1A), as discussed in greater detail above and below with regard to FIG. 10B. The MC-AEC 194 may correspond to the MC-AEC 108*a* illustrated in FIG. 1A, although the disclosure is not limited thereto and the MC-AEC 194 may correspond to multiple MC-AECs 108 without departing from the disclosure. The MC-AEC 194 may weight the audio reference signals U 193 using weights H (e.g., $H_1$-$H_L$) to generate a plurality of echo reference signals (e.g., estimated echo signals $\hat{y}(n)$ 125) and may combine the echo reference signals into a combined (weighted) echo reference signal $\hat{Y}_b$ 196.

To benefit from both the ANC 170 and the MC-AEC 194, the system 100 may combine the combined noise reference signal $\hat{Y}_a$ 176 (e.g., first echo data) and the combined echo reference signal $\hat{Y}_b$ 196 (e.g., second echo data) to generate the interference reference signal $\hat{Y}$ 177 (e.g., combined echo data). The combined noise reference signal $\hat{Y}_a$ 176 may correspond to acoustic noise (represented as "N" in FIG. 1C) and/or nonlinear portions of the acoustic echo, while the combined echo reference signal $\hat{Y}_b$ 196 may correspond to acoustic echo (represented as "E" in FIG. 1C). Thus, the interference reference signal $\hat{Y}$ 177 corresponds to both the acoustic noise and the acoustic echo (represented as "N+E" in FIG. 1C).

In some examples, the system 100 may weight the combined noise reference signal $\hat{Y}_a$ 176 and the combined echo reference signal $\hat{Y}_b$ 196 when generating the interference reference signal $\hat{Y}$ 177. For example, instead of simply adding the combined noise reference signal $\hat{Y}_a$ 176 and the combined echo reference signal $\hat{Y}_b$ 196 to generate the interference reference signal 177, the system 100 may determine a linearity of the system and weight the combined noise reference signal $\hat{Y}_a$ 176 and the combined echo reference signal $\hat{Y}_b$ 196 based on whether the system is linear or nonlinear. Thus, when the system is more linear, a first weight associated with the combined echo reference signal $\hat{Y}_a$ 196 may increase relative to a second weight associated with the combined noise reference signal $\hat{Y}_a$ 176, as the MC-AEC 194 performs well in a linear system. Similarly, when the system is less linear, the first weight associated with the combined echo reference signal $\hat{Y}_b$ 196 may decrease relative to the second weight associated with the combined noise reference signal $\hat{Y}_a$ 176, as the ANC 170 performs well in a nonlinear system. Additionally or alternatively, the system 100 may control how the interference reference signal $\hat{Y}$ 177 is generated using the step-size controller 190. For example, the step-size controller 190 may vary a step-size and/or may update a step-size faster for one of the ANC 170 or the MC-AEC 194 based on a linearity of the system. Thus, the step-size controller 190 may influence how much the interference reference signal $\hat{Y}$ 177 is based on the ANC 170 or the MC-AEC 194.

The system may then subtract the interference reference signal $\hat{Y}$ 177 (e.g., cancel an estimated interference component) from the amplified first audio signal Y' 164 to obtain a difference (e.g., error signal e 178). The system may then output that difference, which represents the desired output audio signal with the noise and echo cancelled. The diffuse noise is cancelled by the FBF 160 when determining the amplified first audio signal Y' 164, the directional noise is cancelled based on the portion of the interference reference signal $\hat{Y}'$ 177 that corresponds to the combined noise reference signal 176, and the acoustic echo is cancelled based on the portion of the interference reference signal $\hat{Y}$ 177 that corresponds to the combined echo reference signal $\hat{Y}_b$ 196.

The system 100 may use the difference (e.g., error signal e 178) to create updated weights (for example, weights $W_1$-$W_P$ for adaptive filters included in the ANC 170 and weights $H_1$-$H_L$ for adaptive filters included in the MC-AEC 194) that may be used to weight future audio signals. To improve performance of the system 100, the system 100 may update the weights for both the ANC 170 and the MC-AEC 194 using the same error signal e 178, such that the ANC 170 and the MC-AEC 194 are jointly adapted. In some examples, the weights are updated at the same time, although the disclosure is not limited thereto and the weights may be updated at different times without departing from the disclosure.

As discussed above, the step-size controller 190 may be used modulate the rate of adaptation from one weight to an updated weight. In some examples, the step-size controller 190 includes a first algorithm associated with the ANC 170 and a second algorithm associated with the MC-AEC 194, such that the step-size is different between the ANC 170 and the MC-AEC 194.

Figure 10A:
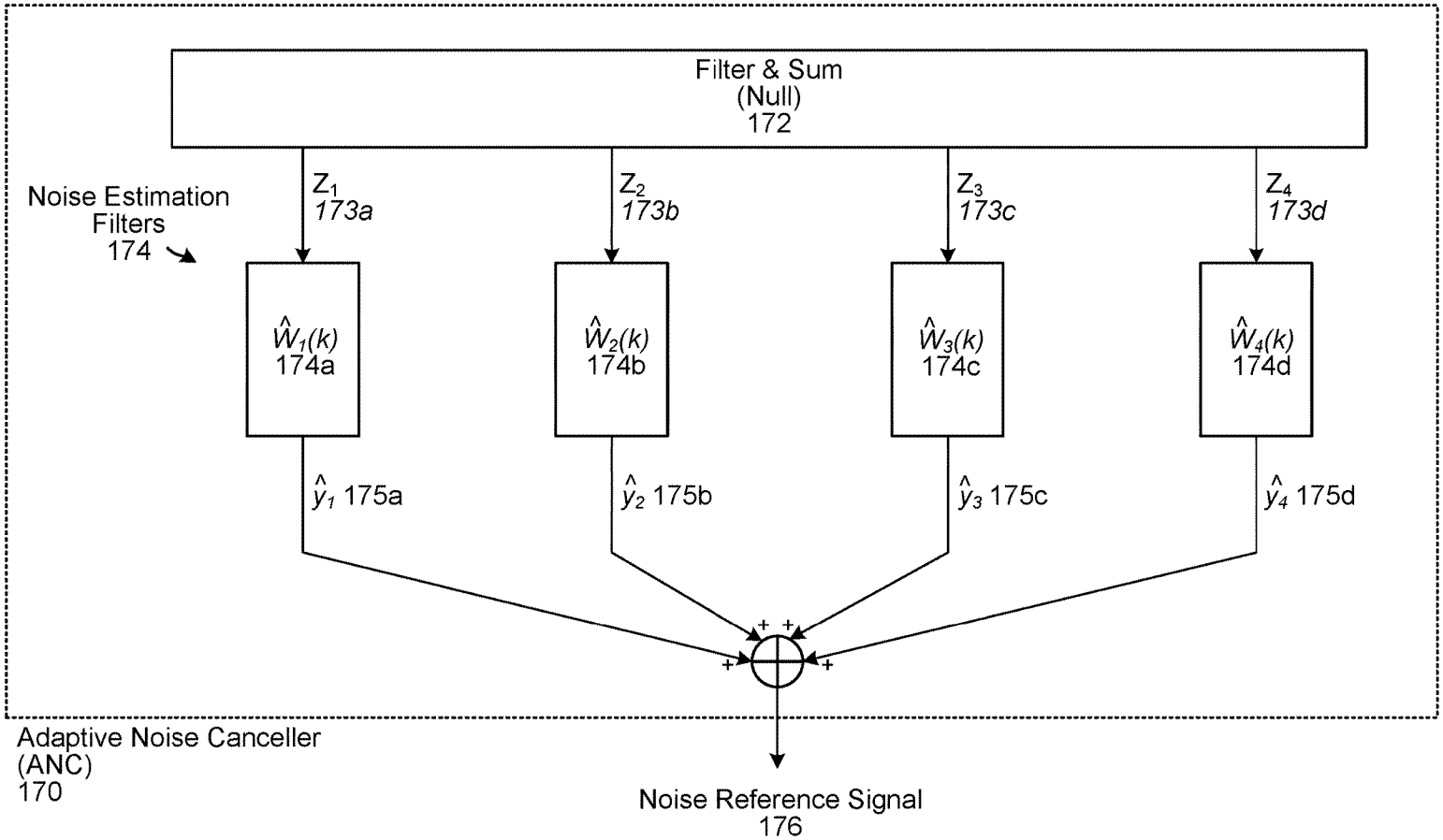
FIGS. 10A-10B illustrate examples of adaptive filters according to embodiments of the present disclosure.
Figure 10B:
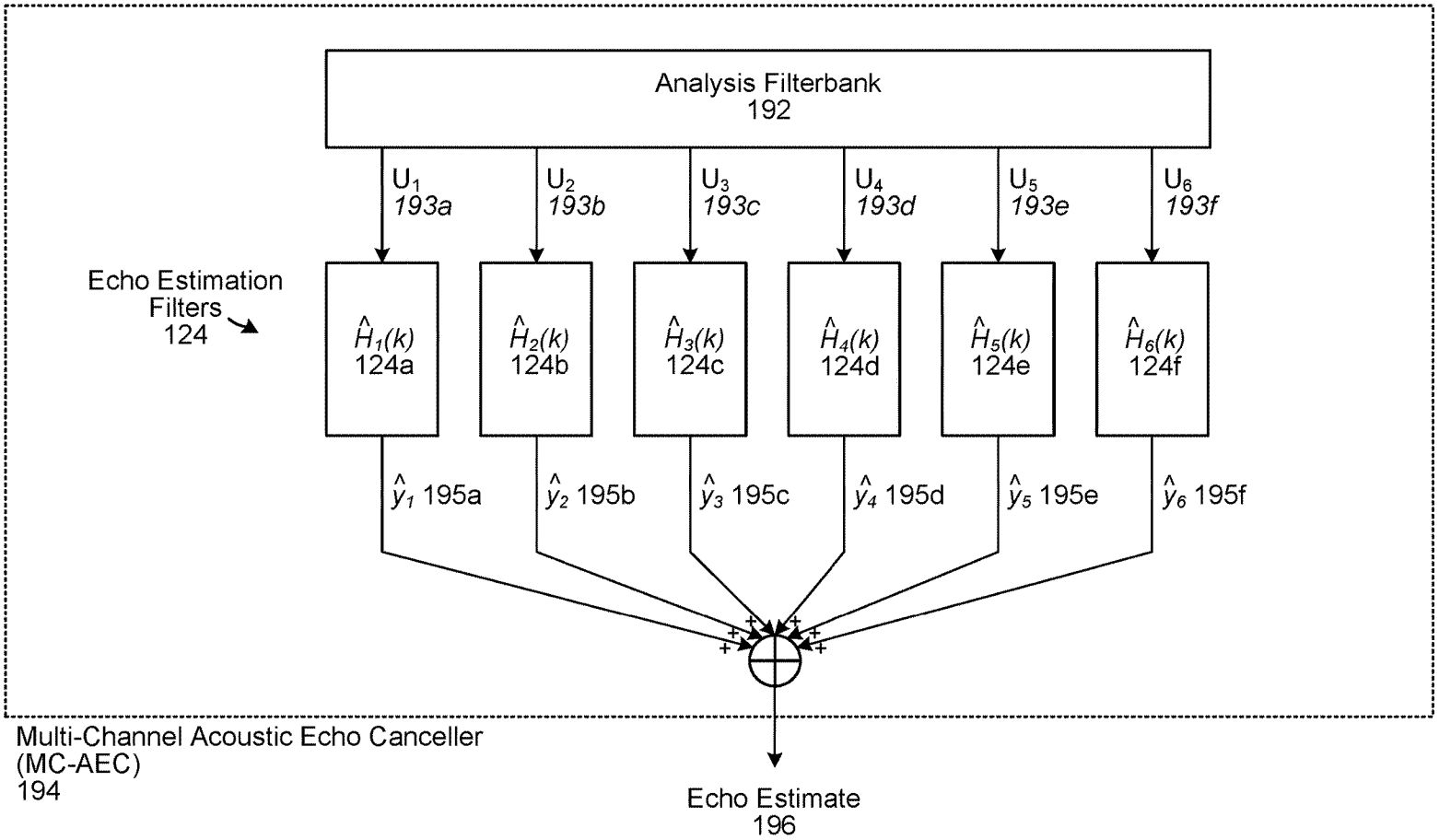

FIGS. 10A-10B illustrate examples of adaptive filters according to embodiments of the present disclosure. As illustrated in FIG. 10A, the filter and sum component 172 may generate noise reference signals Z 173 (e.g., $Z_1$ 173*a*-$Z_4$ 173*d*). The individual noise reference signals Z 173 may then be filtered by noise estimation filter blocks 174 configured with weights W to adjust how much each individual channel's noise reference signal Z 173 should be weighted in the eventual combined noise reference signal Y 176, as discussed above with regard to FIG. 1B. For example, the noise estimation filters 174 (e.g., adaptive filter coefficients) are selected to isolate the noise to be cancelled from the amplified first audio signal Y' 164. The individual channel's weighted noise reference signal $\hat{y}$ 175 is thus the channel's noise reference signal Z 173 multiplied by the channel's weight W. For example, $\hat{y}_1=Z_1*W_1$, $\hat{y}_2=Z_2*W_2$, and so forth. While FIG. 10A illustrates four noise reference signals Z 173 (e.g., 173*a*-173*d*), the disclosure is not limited thereto and the number of reference signals Z 173 generated by the filter and sum component 172 may vary without departing from the disclosure.

Echo estimation filter blocks 124, which are described in greater detail above with regard to FIG. 1A, operate similarly. As illustrated in FIG. 10B, the analysis filterbank 192 may generate echo reference signals U 193 (e.g., $U_1$ 193*a*-$U_6$ 193*f*). The individual echo reference signals U 193 may then be filtered by echo estimation filter blocks 124 configured with weights H to adjust how much each individual channel's echo reference signal should be weighted in the eventual combined echo reference signal $\hat{Y}$ 196, as discussed above with regard to FIG. 1A. For example, the echo estimation filters 124 (e.g., adaptive filter coefficients) are selected to isolate the echo to be cancelled from the amplified first audio signal Y' 164. The individual channel's weighted echo reference signal $\hat{y}$ 195 is thus the channel's echo reference signal U 193 multiplied by the channel's weight H. For example, $\hat{y}_1=U_1*H_1$, $\hat{y}_2=U_2*H_2$, and so forth. The echo reference signals $\hat{y}$ 195 may be combined to generate the combined echo reference signal $\hat{Y}$ 196. While FIG. 10B illustrates six echo reference signals U 193 (e.g., 193*a*-193*f*) (e.g., 5.1 audio having six unique channels), the disclosure is not limited thereto and the number of echo reference signals U 193 generated by the analysis filterbank 192 may vary without departing from the disclosure. For example, the number of echo reference signals U 193 typically corresponds to the number of unique channels sent to the loudspeakers 114, such as two channels (e.g., stereo audio), three channels (e.g., 2.1 audio), six channels (e.g., 5.1 audio), eight channels (e.g., 7.1 audio) or the like.

The system 100 may use the noise reference signals Z 173 (e.g., $Z_p(k,n)$) and the echo reference signals U 193 (e.g., $U_l(k,n)$) to jointly estimate the acoustic noise and acoustic echo components (hereby termed acoustic interference estimate) in the FBF 160 output (e.g., the amplified first audio signal Y' 164). The system 100 may use the noise filters (e.g., $W_p(k,n)$) and the echo estimation filters (e.g., $H_l(k,n)$). The contribution for the interference estimate by the ANC 170 is given as:

$$\hat{Y}_{AIC}(k,n)=\sum_{p=1}^{P}\hat{Y}_{p,AIC}(k,n) \quad [14]$$

where $$\hat{Y}_{p,AIC}(k,n)=\sum_{r=0}^{R_1}W_p(k,n,r)Z_p(k,n-r) \quad [15]$$

with $W_p(k,n,r)$ denoting the rth element of $W_p(k,n)$. Likewise, the contribution for the interference estimate by the MC-AEC 194 is given as:

$$\hat{Y}_{MC-AEC}(k,n)=\sum_{l=1}^{L}\hat{Y}_{l,MC-AEC}(k,n) \quad [16]$$

where $$\hat{Y}_{l,MC-AEC}(k,n)=\sum_{r=0}^{R_2}H_l(k,n,r)U_l(k,n-r) \quad [17]$$

with, $H_l(k,n,r)$ denoting the rth element of $H_l(k,n)$. The overall interference estimate is then obtained by adding the contributions of the ANC and MC-AEC algorithms:

$$\hat{Y}(k,n)=\hat{Y}_{AIC}(k,n)+\hat{Y}_{MC\text{-}AEC}(k,n) \quad [18]$$

This noise estimate is subtracted from the FBF 160 output (e.g., the amplified first audio signal Y' 164) to obtain the error signal e 178:

$$E(k,n)=Y(k,n)-\hat{Y}(k,n) \quad [19]$$

Lastly, the error signal e 178 is used to update the filter coefficients (e.g., noise estimation filter blocks 174) for the ANC 170 using subband adaptive filters like the NLMS (normalized least mean square) algorithm:

$$W_p(k,n)=W_p(k,n-1)+\frac{\mu_{p,AIC}(k,n)}{\|Z_p(k,n)\|^2+\varepsilon}Z_p(k,n)E(k,n) \quad [20]$$

where, $Z_p(k,n)=[Z_p(k,n)\ Z_p(k,n-1)\ \ldots\ Z_p(k,n-R_1)]^T$ is the noise estimation vector for the pth channel, $\mu_{p,AIC}(k,n)$ is the adaptation step-size for the pth channel, and ε is a regularization factor. Likewise, the filter coefficients (e.g., echo estimation filter blocks 124) for the MC-AEC 194 are updated as:

$$H_l(k,n)=H_l(k,n-1)+\frac{\mu_{l,MC-AEC}(k,n)}{\|U_l(k,n)\|^2+\varepsilon}U_l(k,n)E(k,n) \quad [21]$$

where, $U_l(k,n)=[U_l(k,n)\ U_l(k,n-1)\ \ldots\ U_l(k,n-R_2)]^T$ is the playback reference vector for the lth channel. Note that the step-sizes $\mu_{p,AIC}(k,n)$ and $\mu_{l,MC\text{-}AEC}(k,n)$ are updated using the step-size controller 190, as discussed in greater detail above.

Figure 11:
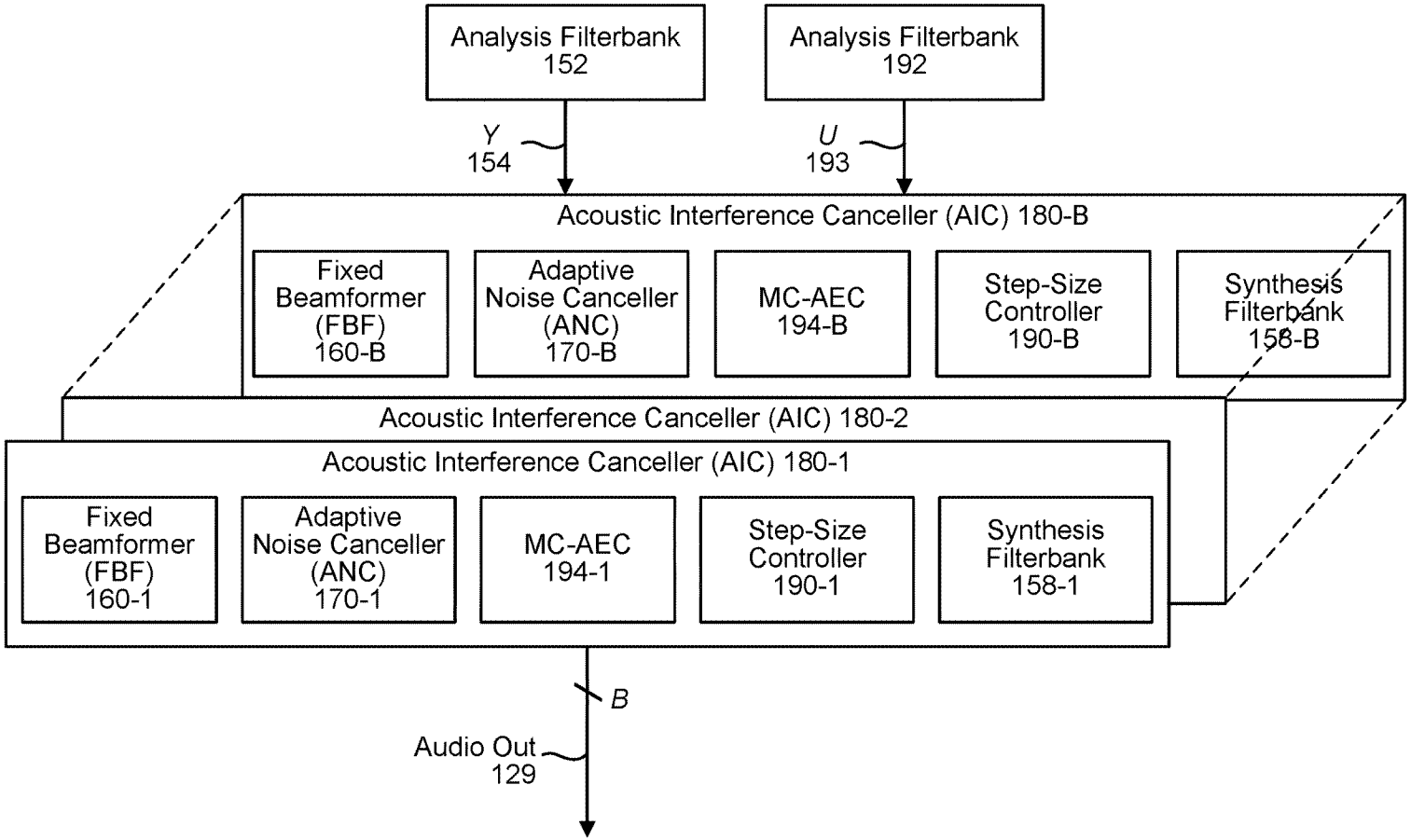
FIG. 11 illustrates a configuration having an acoustic interference canceller for each beam according to embodiments of the present disclosure.

As illustrated in FIG. 11, the acoustic interference canceller (AIC) 180 (including the FBF 160, the ANC 170, the MC-AEC 194, the step-size controller 190 and/or the synthesis filterbank 158) illustrated in FIG. 1C may be implemented multiple times in a single AIC system 100. The analysis filterbank 152 and the analysis filterbank 192 are common to all of the AICs 180. For example, all of the AICs 180 may receive the input signals Y 154 from the analysis filterbank 152 and the audio reference signals U 193 from the analysis filterbank 192.

The number of AIC 180 blocks may correspond to the number of beams B. For example, if there are eight beams, there may be eight FBF components 160, eight ANC components 170, eight MC-AEC components 194, eight step-size controller components 190 and eight synthesis filterbank components 158. Each AIC 180 may operate as described in reference to FIG. 1C, with an individual output e (e.g., error signal 178) for each beam created by the respective AIC 180. Thus, B different error signals 178 may result. Each individual beam pipeline may result in its own audio output 129, such that there may be B different audio outputs 129. A downstream component, for example a speech recognition component, may receive all the different audio outputs 129 and may use some processing to determine which beam (or beams) correspond to the most desirable audio output data (for example a beam with a highest SNR output audio data or the like).

Each particular AIC 180 may include a FBF 160 tuned with beamformer filter coefficients h to boost audio from one of the particular beams. For example, FBF 160-1 may be tuned to boost audio from beam 1, FBF 160-2 may be tuned to boost audio from beam 2 and so forth. If the filter block is associated with the particular beam, its beamformer filter coefficient h will be high whereas if the filter block is associated with a different beam, its beamformer filter coefficient h will be lower. For example, for FBF 160-7 direction 7, the beamformer filter coefficient $h_7$ for filter block 822*g* may be high while beamformer filter coefficients $h_1$-$h_6$ and $h_8$ may be lower. Thus the filtered audio signal $y_7$ will be comparatively stronger than the filtered audio signals $y_1$-$y_6$ and $y_8$ thus boosting audio from direction 7 relative to the other directions. The filtered audio signals will then be summed together to create the amplified first audio signal Y' 164. Thus, the FBF 160-7 may phase align microphone data toward a given direction and add it up. Signals that are arriving from a particular direction (e.g., look direction) are reinforced, but signals that are not arriving from the look direction are suppressed. The robust FBF coefficients are designed by solving a constrained convex optimization problem and by specifically taking into account the gain and phase mismatch on the microphones.

Figure 12:
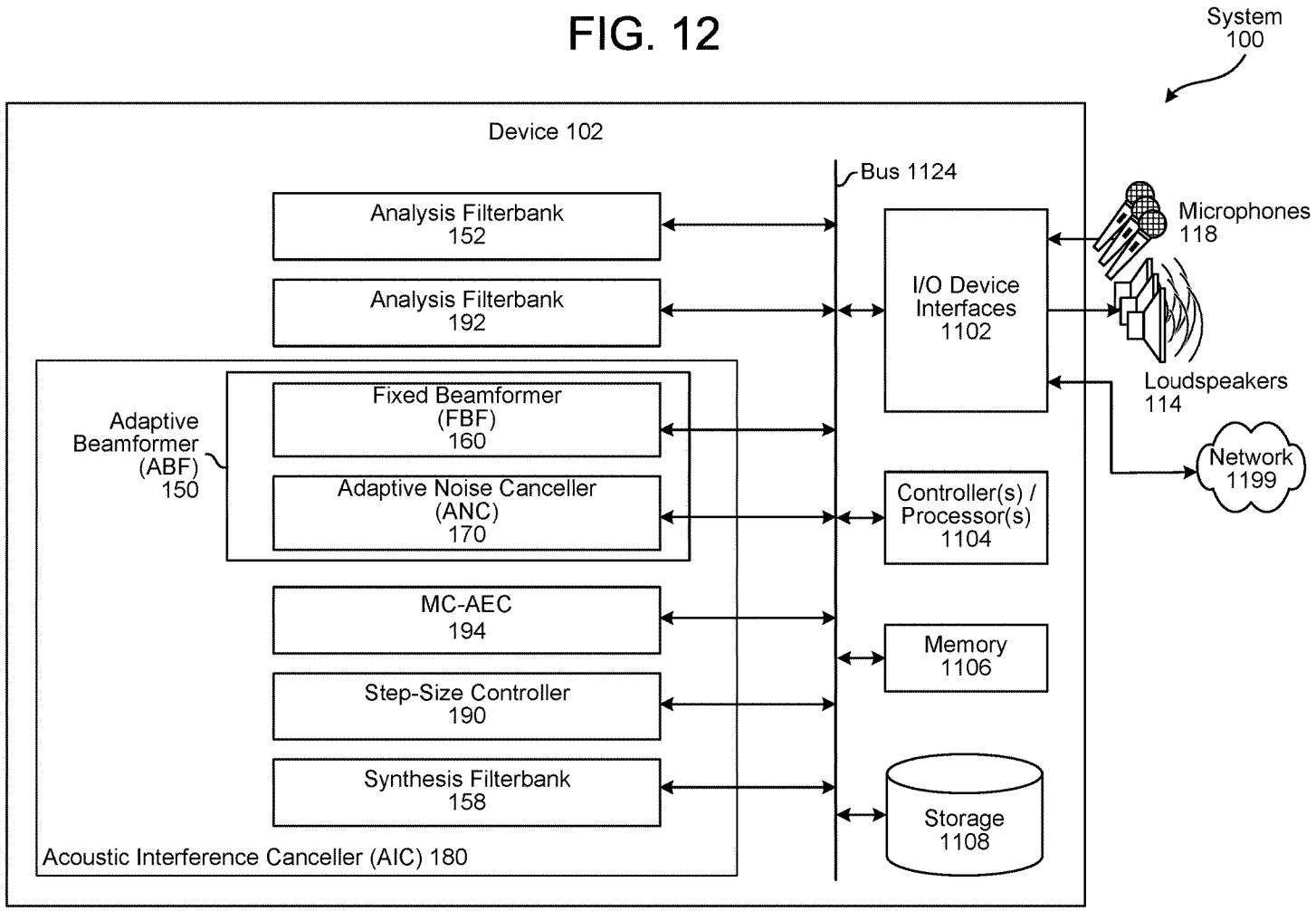
FIG. 12 is a block diagram conceptually illustrating example components of a system for acoustic interference cancellation according to embodiments of the present disclosure.

FIG. 12 is a block diagram conceptually illustrating example components of the system 100. In operation, the system 100 may include computer-readable and computer-executable instructions that reside on the device 102, as will be discussed further below.

The system 100 may include one or more audio capture device(s), such as a microphone 118 or an array of microphones 118. The audio capture device(s) may be integrated into the device 102 or may be separate.

The system 100 may also include an audio output device for producing sound, such as loudspeaker(s) 114. The audio output device may be integrated into the device 102 or may be separate.

The device 102 may include an address/data bus 1224 for conveying data among components of the device 102. Each component within the device 102 may also be directly connected to other components in addition to (or instead of) being connected to other components across the bus 1224.

The device 102 may include one or more controllers/processors 1204, which may each include a central processing unit (CPU) for processing data and computer-readable instructions, and a memory 1206 for storing data and instructions. The memory 1206 may include volatile random access memory (RAM), non-volatile read only memory (ROM), non-volatile magnetoresistive (MRAM) and/or other types of memory. The device 102 may also include a data storage component 1208, for storing data and controller/processor-executable instructions. The data storage component 1208 may include one or more non-volatile storage types such as magnetic storage, optical storage, solid-state storage, etc. The device 102 may also be connected to removable or external non-volatile memory and/or storage (such as a removable memory card, memory key drive, networked storage, etc.) through the input/output device interfaces 1202.

Computer instructions for operating the device 102 and its various components may be executed by the controller(s)/processor(s) 1204, using the memory 1206 as temporary "working" storage at runtime. The computer instructions may be stored in a non-transitory manner in non-volatile memory 1206, storage 1208, or an external device. Alternatively, some or all of the executable instructions may be embedded in hardware or firmware in addition to or instead of software.

The device 102 includes input/output device interfaces 1202. A variety of components may be connected through the input/output device interfaces 1202, such as the loudspeaker(s) 114, the microphones 118, and a media source such as a digital media player (not illustrated). The input/output interfaces 1202 may include A/D converters for converting the output of microphone 118 into echo signals y 120, if the microphones 118 are integrated with or hardwired directly to device 102. If the microphones 118 are independent, the A/D converters will be included with the microphones, and may be clocked independent of the clocking of the device 102. Likewise, the input/output interfaces 1202 may include D/A converters for converting the reference signals x 112 into an analog current to drive the loudspeakers 114, if the loudspeakers 114 are integrated with or hardwired to the device 102. However, if the loudspeakers are independent, the D/A converters will be included with the loudspeakers, and may be clocked independent of the clocking of the device 102 (e.g., conventional Bluetooth loudspeakers).

The input/output device interfaces 1202 may also include an interface for an external peripheral device connection such as universal serial bus (USB), FireWire, Thunderbolt or other connection protocol. The input/output device interfaces 1202 may also include a connection to one or more networks 1299 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 1299, the system 100 may be distributed across a networked environment.

The device 102 further includes an analysis filterbank 152, an analysis filterbank 192 and one or more acoustic interference cancellers (AIC) 180. Each AIC 180 includes a multi-channel acoustic echo canceller (MC-AEC) 194, an adaptive beamformer 150, which includes a fixed beamformer (FBF) 160 and an adaptive noise canceller (ANC) 170, a step-size controller 190 and/or s synthesis filterbank 158.

Multiple devices 102 may be employed in a single system 100. In such a multi-device system, each of the devices 102 may include different components for performing different aspects of the AEC process. The multiple devices may include overlapping components. The components of device 102 as illustrated in FIG. 12 is exemplary, and may be a stand-alone device or may be included, in whole or in part, as a component of a larger device or system. For example, in certain system configurations, one device may transmit and receive the audio data, another device may perform AEC, and yet another device my use the audio outputs 129 for operations such as speech recognition.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the MC-AECs 108 may be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method implemented on a voice-controllable device to perform acoustic interference cancellation, the method comprising:

sending first playback audio data to a first loudspeaker;

receiving first input audio data from a first microphone of a microphone array, the first input audio data including a first representation of audible sound output by the first loudspeaker and a first representation of speech input;

receiving second input audio data from a second microphone of the microphone array, the second input audio data including a second representation of the audible sound output by the first loudspeaker and a second representation of the speech input;

generating combined input audio data comprising at least the first input audio data and the second input audio data, the combined input audio data including a third representation of the audible sound output by the first loudspeaker and a third representation of the speech input;

determining a first directional portion of the combined input audio data, the first directional portion comprising a first portion of the first input audio data corresponding to a first direction and a first portion of the second input audio data corresponding to the first direction; and determining a second directional portion of the combined input audio data, the second directional portion comprising a second portion of the first input audio data corresponding to a second direction and a second portion of the second input audio data corresponding to the second direction;

determining target data that includes the first directional portion;

determining first reference data that includes the second directional portion;

determining, using a first adaptive filter and the first reference data, interference data that models a first interference portion of the combined input audio data, the interference data corresponding to at least one of the third representation of the audible sound or a representation of ambient acoustic noise;

determining, using a second adaptive filter and the first playback audio data, echo data that models a second interference portion of the combined input audio data, the echo data corresponding to the third representation of the audible sound;

combining the interference data and the echo data to generate combined interference data; and subtracting the combined interference data from the target data to generate first output audio data that includes data corresponding to the representation of speech input.

2. The computer-implemented method of claim 1, further comprising:

determining a first plurality of adaptive filter coefficients corresponding to the first direction;

determining a first portion of the target data from the first directional portion using a first adaptive filter coefficient of the first plurality of adaptive filter coefficients;

determining a second portion of the target data from the second directional portion using a second adaptive filter coefficient of the first plurality of adaptive filter coefficients; and generating the target data by summing the first portion of the target data and the second portion of the target data.

3. The computer-implemented method of claim 1, further comprising:

determining a first plurality of adaptive filter coefficients corresponding to the first adaptive filters;

determining the interference data by convolving the combined input audio data with the first plurality of adaptive filter coefficients;

determining a second plurality of adaptive filter coefficients corresponding to the second adaptive filters; and determining the echo data by convolving the first playback audio data with the second plurality of adaptive filter coefficients.

4. The computer-implemented method of claim 3, further comprising:

determining, based on the first output audio data, a third plurality of adaptive filter coefficients corresponding to the first adaptive filters;

determining, based on the first output audio data, a fourth plurality of adaptive filter coefficients corresponding to the second adaptive filters;

updating the first adaptive filters with the third plurality of adaptive filter coefficients at a first time; and updating the second adaptive filters with the fourth plurality of adaptive filter coefficients at the first time.

5. A computer-implemented method, comprising:

sending first playback audio data to a first loudspeaker;

receiving combined input audio data, the combined input audio data including a representation of audible sound output by the first loudspeaker and a representation of speech input;

determining target data that includes a first directional portion of the combined input audio data that corresponds to a first direction;

determining first reference data that includes a second directional portion of the combined input audio data that does not correspond to the first direction;

determining, using a first adaptive filter and the first reference data, interference data that models a first interference portion of the combined input audio data, the interference data corresponding to at least one of the representation of the audible sound or a representation of ambient acoustic noise;

determining, using a second adaptive filter and the first playback audio data, echo data that models a second interference portion of the combined input audio data, the echo data corresponding to the representation of the audible sound;

combining the interference data and the echo data to generate combined interference data; and subtracting the combined interference data from the target data to generate first output audio data that includes data corresponding to the representation of speech input.

6. The computer-implemented method of claim 5, further comprising:

receiving first input audio data from a first microphone of a microphone array, the first input audio data including a first representation of the audible sound output by the first loudspeaker and a first representation of the speech input;

receiving second input audio data from a second microphone of the microphone array, the second input audio data including a second representation of the audible sound output by the first wireless loudspeaker and a second representation of the speech input;

generating the combined input audio data comprising at least the first input audio data and the second input audio data;

determining the first directional portion, the first directional portion comprising a first portion of the first input audio data corresponding to the first direction and a first portion of the second input audio data corresponding to the first direction; and determining the second directional portion, the second directional portion comprising a second portion of the first input audio data corresponding to a second direction and a second portion of the second input audio data corresponding to the second direction.

7. The computer-implemented method of claim 6, further comprising:

determining a first magnitude value corresponding to the first directional portion;

determining a second magnitude value corresponding to the second directional portion;

determining that the first magnitude value is greater than the second magnitude value;

selecting at least the first directional portion as the target data;

selecting at least the second directional portion as the first reference data.

8. The computer-implemented method of claim 6, further comprising:

determining a first plurality of filter coefficients corresponding to the first direction;

determining a first portion of the target data from the first directional portion using a first filter coefficient of the first plurality of filter coefficients;

determining a second portion of the target data from the second directional portion using a second filter coefficient of the first plurality of filter coefficients; and generating the target data by summing the first portion of the target data and the second portion of the target data.

9. The computer-implemented method of claim 5, further comprising:

determining a first plurality of filter coefficients corresponding to the first direction;

determining the target data by convolving the combined input audio data with the first plurality of filter coefficients;

determining a second plurality of filter coefficients corresponding to a second direction that is different than the first direction; and determining at least a portion of the first reference data by convolving the combined input audio data with the second plurality of filter coefficients.

10. The computer-implemented method of claim 5, further comprising:

determining a first plurality of adaptive filter coefficients corresponding to the first adaptive filters;

determining the interference data by convolving the combined input audio data with the first plurality of adaptive filter coefficients;

determining a second plurality of adaptive filter coefficients corresponding to the second adaptive filters; and determining the echo data by convolving the first playback audio data with the second plurality of adaptive filter coefficients.

11. The computer-implemented method of claim 10, further comprising:

determining, based on the first output audio data, a third plurality of adaptive filter coefficients corresponding to the first adaptive filters;

determining, based on the first output audio data, a fourth plurality of adaptive filter coefficients corresponding to the second adaptive filters;

updating the first adaptive filters with the third plurality of adaptive filter coefficients at a first time; and updating the second adaptive filters with the fourth plurality of adaptive filter coefficients at the first time.

12. The computer-implemented method of claim 5, further comprising:

determining a first step-size value, the first step-size value corresponding to a first duration of time, a first frequency range and a first adaptive filter of the first adaptive filters;

determining a second step-size value, the second step-size value corresponding to the first duration of time, a second frequency range and a second adaptive filter of the first adaptive filters;

determining a third step-size value, the third step-size value corresponding to the first duration of time, the first frequency range and a third adaptive filter of the second adaptive filters;

determining a fourth step-size value, the fourth step-size value corresponding to the first duration of time, the second frequency range and a fourth adaptive filter of the second adaptive filters;

sending the first step-size value to the first adaptive filter at a first time;

sending the second step-size value to the second adaptive filter at the first time;

sending the third step-size value to the third adaptive filter at a second time that is different than the first time; and sending the fourth step-size value to the fourth adaptive filter at the second time.

13. A first device, comprising:

at least one processor;

a wireless transceiver; and a memory device including first instructions operable to be executed by the at least one processor to configure the first device to:

send first playback audio data to a first loudspeaker;

receive combined input audio data, the combined input audio data including a representation of audible sound output by the first loudspeaker and a representation of speech input;

determine target data that includes a first directional portion of the combined input audio data that corresponds to a first direction;

determine first reference data that includes a second directional portion of the combined input audio data that does not correspond to the first direction;

determine, using a first adaptive filter and the first reference data, interference data that models a first interference portion of the combined input audio data, the interference data corresponding to the representation of the audible sound or a representation of ambient acoustic noise;

determine, using a second adaptive filter and the first playback audio data, echo data that models a second interference portion of the combined input audio data, the echo data corresponding to the representation of the audible sound;

combine the interference data and the echo data to generate combined interference data; and subtract the combined interference data from the target data to generate first output audio data that includes data corresponding to the representation of speech input.

14. The first device of claim 13, wherein the first instructions further configure the first device to:

receive first input audio data from a first microphone of a microphone array, the first input audio data including a first representation of the audible sound output by the first loudspeaker and a first representation of the speech input;

receive second input audio data from a second microphone of the microphone array, the second input audio data including a second representation of the audible sound output by the first wireless loudspeaker and a second representation of the speech input;

generate the combined input audio data comprising at least the first input audio data and the second input audio data;

determine the first directional portion, the first directional portion comprising a first portion of the first input audio data corresponding to the first direction and a first portion of the second input audio data corresponding to the first direction; and determine the second directional portion, the second directional portion comprising a second portion of the first input audio data corresponding to a second direction and a second portion of the second input audio data corresponding to the second direction.

15. The first device of claim 14, wherein the first instructions further configure the first device to:

determine a first magnitude value corresponding to the first directional portion;

determine a second magnitude value corresponding to the second directional portion;

determine that the first magnitude value is greater than the second magnitude value;

selecting at least the first directional portion as the target data;

selecting at least the second directional portion as the first reference data.

16. The first device of claim 14, wherein the first instructions further configure the first device to:

determine a first plurality of filter coefficients corresponding to the first direction;

determine a first portion of the target data from the first directional portion using a first filter coefficient of the first plurality of filter coefficients;

determine a second portion of the target data from the second directional portion using a second filter coefficient of the first plurality of filter coefficients; and generate the target data by summing the first portion of the target data and the second portion of the target data.

17. The first device of claim 13, wherein the first instructions further configure the first device to:

determine a first plurality of filter coefficients corresponding to the first direction;

determine the target data by convolving the combined input audio data with the first plurality of filter coefficients;

determine a second plurality of filter coefficients corresponding to a second direction that is different than the first direction; and determine at least a portion of the first reference data by convolving the combined input audio data with the second plurality of filter coefficients.

18. The first device of claim 13, wherein the first instructions further configure the first device to:

determine a first plurality of adaptive filter coefficients corresponding to the first adaptive filters;

determine the interference data by convolving the combined input audio data with the first plurality of adaptive filter coefficients;

determine a second plurality of adaptive filter coefficients corresponding to the second adaptive filters; and determine the echo data by convolving the first playback audio data with the second plurality of adaptive filter coefficients.

19. The first device of claim 18, wherein the first instructions further configure the first device to:

determine, based on the first output audio data, a third plurality of adaptive filter coefficients corresponding to the first adaptive filters;

determine, based on the first output audio data, a fourth plurality of adaptive filter coefficients corresponding to the second adaptive filters;

update the first adaptive filters with the third plurality of adaptive filter coefficients at a first time; and update the second adaptive filters with the fourth plurality of adaptive filter coefficients at the first time.

20. The first device of claim 13, wherein the first instructions further configure the first device to:

determine a first step-size value, the first step-size value corresponding to a first duration of time, a first frequency range and a first adaptive filter of the first adaptive filters;

determine a second step-size value, the second step-size value corresponding to the first duration of time, a second frequency range and a second adaptive filter of the first adaptive filters;

determine a third step-size value, the third step-size value corresponding to the first duration of time, the first frequency range and a third adaptive filter of the second adaptive filters;

determine a fourth step-size value, the fourth step-size value corresponding to the first duration of time, the second frequency range and a fourth adaptive filter of the second adaptive filters;

send the first step-size value to the first adaptive filter at a first time;

send the second step-size value to the second adaptive filter at the first time;

send the third step-size value to the third adaptive filter at a second time that is different than the first time; and send the fourth step-size value to the fourth adaptive filter at the second time.

* * * * *